US007325337B2

(12) United States Patent
Cox et al.

(10) Patent No.: US 7,325,337 B2
(45) Date of Patent: Feb. 5, 2008

(54) STRIPE CHANGES FOR FOOTWEAR

(75) Inventors: Donald R. Cox, Wildwood, MO (US); Raymond F. Tonkel, Sudbury, MA (US)

(73) Assignee: U-Turn Sports Co., LLC

( * ) Notice: Subject to any disclaimer, the term of this patent is extended or adjusted under 35 U.S.C. 154(b) by 423 days.

(21) Appl. No.: 10/896,393

(22) Filed: Jul. 22, 2004

(65) Prior Publication Data

US 2005/0016032 A1 Jan. 27, 2005

Related U.S. Application Data

(60) Continuation-in-part of application No. 10/720,317, filed on Nov. 24, 2003, now Pat. No. 7,028,420, and a continuation-in-part of application No. 10/437,140, filed on May 13, 2003, now abandoned, which is a division of application No. 10/122,995, filed on Apr. 11, 2002, now Pat. No. 6,574,887.

(60) Provisional application No. 60/575,850, filed on Jun. 1, 2004, provisional application No. 60/491,343, filed on Jul. 29, 2003, provisional application No. 60/442,817, filed on Jan. 28, 2003, provisional application No. 60/430,967, filed on Dec. 4, 2002, provisional application No. 60/285,693, filed on Apr. 24, 2001.

(51) Int. Cl.
*A43B 3/24* (2006.01)
*A43B 23/00* (2006.01)

(52) U.S. Cl. ..... 36/136; 36/100; 36/45

(58) Field of Classification Search ..... 36/136, 36/100, 101, 11.5, 45, 15, 50.1; 2/244–246
See application file for complete search history.

(56) References Cited

U.S. PATENT DOCUMENTS

| | | | |
|---|---|---|---|
| 418,966 | A | 1/1890 | Welander |
| 752,254 | A | 2/1904 | Patton |
| 760,401 | A | 5/1904 | Sandmeyer |
| 911,740 | A | 2/1909 | Montgomery |
| 1,394,348 | A | 10/1921 | Pietrowski |
| 1,797,309 | A | 3/1931 | Wojciechowski |

(Continued)

*Primary Examiner*—Marie Patterson
(74) *Attorney, Agent, or Firm*—Paul M. Denk

(57) ABSTRACT

A changeable stripe for footwear, that can be applied to any segment of the shoe, or other clothing, or even a purse or backpack, and includes a changeable stripe that is held by means of a base, or through slots provided within the shoe, so that a pull tab connecting to the ends of the stripe can be shifted in one direction or the other to disclose different surface features of the stripe, to change or vary the coloration or design of the shown stripe. The changeable stripe may be applied directly and integrally into the structure of the shoe component, or it may be held by an independent base structure and applied by stitching or adhesive to the shoe. Each stripe may have pivotal segments that allows for turning of a portion of a stripe, so as to display other coloration. Such changeable stripes can be applied to the surface of the shoe, can be applied over the vamp of a sandal, the vamp of a beach shoe, or to other clothing or items, as desired. The changeable stripe may also be held by D-rings, buckles, or clasps, to the surface of the shoe. Shiftable stripes may be located upon the surface of the footwear, within sleeves, and be shifted to also vary the coloration or design as displayed for the shoe.

13 Claims, 20 Drawing Sheets

U.S. PATENT DOCUMENTS 2,599,740 A * 6/1952 Beveridge ..... 36/11.5
2,614,339 A 10/1952 Herceg
2,669,036 A * 2/1954 Israel ..... 36/11.5
2,696,057 A * 12/1954 Flautt ..... 36/11.5
3,011,281 A 12/1961 King
3,205,544 A 9/1965 Streule et al.
3,325,918 A 6/1967 Weitzner
3,878,626 A * 4/1975 Isman ..... 36/15
4,461,102 A 7/1984 DeVincentis
4,485,496 A 12/1984 Shanks, Jr.
4,516,337 A 5/1985 Adamik
4,566,207 A * 1/1986 Struntz ..... 36/50.1
4,592,154 A * 6/1986 Oatman ..... 36/114
4,697,362 A 10/1987 Wasserman
4,733,439 A * 3/1988 Gentry ..... 206/338
4,766,682 A * 8/1988 Malloy, III ..... 36/132
4,805,321 A 2/1989 Tonkel
4,837,948 A 6/1989 Cho
4,907,352 A 3/1990 Ginsberg
4,958,459 A 9/1990 Davidson
5,065,531 A 11/1991 Prestridge
5,165,190 A * 11/1992 Smyth ..... 36/50.1
5,357,689 A 10/1994 Awai
5,379,533 A 1/1995 Swartz
5,388,315 A * 2/1995 Jones ..... 24/712.1
5,459,947 A * 10/1995 Lasher ..... 36/54
5,496,612 A * 3/1996 Ransbottom ..... 428/99
5,551,172 A 9/1996 Yu
5,647,104 A * 7/1997 James ..... 24/68 SK
5,819,439 A * 10/1998 Sanchez ..... 36/89
5,933,985 A * 8/1999 James ..... 36/50.1
6,115,948 A 9/2000 Mitchell
6,212,797 B1 4/2001 Merry et al.
6,240,657 B1 6/2001 Weber et al.
6,543,157 B2 * 4/2003 Pan ..... 36/11.5
6,601,323 B2 8/2003 Tsujino et al.
6,684,543 B2 * 2/2004 Fernau ..... 40/636
2002/0046476 A1 4/2002 Snyder
2002/0078600 A1 * 6/2002 Berg et al. ..... 36/101
2004/0003516 A1 * 1/2004 Jacobs ..... 36/50.1

* cited by examiner

STRIPE CHANGES FOR FOOTWEAR

CROSS REFERENCE TO RELATED APPLICATIONS

This application claims priority upon the provisional application filed on Jul. 29, 2003, under Ser. No. 60/491,343; this application claims priority upon the provisional patent application having Ser. No. 60/575,850, filed on Jun. 1, 2004; and, this application is a continuation-in-part of the patent application having Ser. No. 10/720,317, filed on Nov. 24, 2003 now U.S. Pat. No. 7,028,420, which application claims priority upon the provisional application having Ser. No. 60/430,967, filed on Dec. 4, 2002, and further claims priority upon the provisional patent application having Ser. No. 60/442,817, which was filed on Jan. 28, 2003.

This application is also a continuation-in-part, and claims priority, upon the application having Ser. No. 10/437,140, filed on May 13, 2003 now abandoned which application is a division of the application having Ser. No. 10/122,995, filed Apr. 11, 2002 now U.S. Pat. No. 6,574,887, issued on Jun. 10, 2003, and which patent claims priority upon the provisional application having Ser. No. 60/285,693, filed on Apr. 24, 2001.

BACKGROUND OF THE INVENTION

This invention relates principally to footwear, and more specifically, provides for various shiftable stripes integrated into the structure of the shoe and which may be moved to provide for a coloration change or variation in design, or words with respect to the aesthetics of the footwear.

Various ornamental features have been added to footwear over the years. More specifically, with respect to the early style of footwear, various types of kilties would be applied to the shoes and changed, in order to vary the coloration or design for the shoe upon which they were embodied. In addition, with the advent of the athletic shoe, walking shoe, or jogging type of shoe, enhanced coloration was added to the shoe, since most of such footwear is fabricated of a more cloth like material, with the exception of the sole, and cloth was more susceptible to having various colorations and different designs, for the select textile portions of such shoes as fabricated. For example, the back of a shoe may have been of one color, and the quarter portions may have been of a different color, in order to add different coloration to the footwear. Millions of these styles of fabricated shoes have been sold over the past thirty years, and in fact, that type of footwear probably constitutes the majority of contemporary footwear sales at least in the United States.

With respect to ways to change coloration for shoes, contemporarily, the prior art discloses the existence of such designs in footwear.

For example, the early patent to Weitzner, U.S. Pat. No. 3,325,918, discloses a shoe heel and over shoe assembly wherein flexible plastic sheet, insert, could be coiled onto a spindle within the heel proper of the shoe, and turned in position, by means of a shaft to provide for variation in the coloration, particularly of the heel segment of the shoe, as can be noted.

The patent to Adamik, U.S. Pat. No. 4,516,337, shows means for displaying a picture or the like within a shoe structure. In this particular embodiment, a sleeve was formed along the quarter portion of the shoe, and into which a picture or other indicia could be inserted, apparently under a transparent or cellophane overlay, to provide for different displays, during usage of such shoe.

The patent to Tonkel, U.S. Pat. No. 4,805,321, shoes a reversible shoe tongue that can be changed over, from its top to its bottom, to provide for variations in coloration and design, as displayed upon the shoe structure.

The patent to Lasher, U.S. Pat. No. 5,459,947, shows a decorative shoe tongue overlaying the lace securing device. This is a device, like an overlay, that can be applied in conjunction with the shoe lacing, held in position by Velcro, for furnishing a supplemental display over the lacing, during usage of the shoe.

The patent to Merry, et al, U.S. Pat. No., 6,212,797, shows footwear with a detachable spat. The spat could also provide for different color and design, to provide for color coordination for the footwear in which the spat was incorporated.

Another prior art style of footwear, for use for varying its appearance, is shown in the Mitchell patent, U.S. Pat. No. 6,115,948, which discloses a decorative attachment for articles of clothing and footwear. It simply includes a pouch or sleeves, into which an insertable patch may be located, or an emblem, to vary the décor of the shoe upon which the attachment locates.

Finally, a publication to Snyder, Patent No. 2002/0046476, shows a changeable color insert for shoes. This insert shows a variation upon the tongue, or along the top of the shoe or sandal, and which apparently may be varied through changeable inserts for presenting different logos, coloration, or the like.

SUMMARY OF THE INVENTION

The principal concept of this invention is to provide for various stripes at locations upon the surface of the shoe, whether it be its quarter portions, counter, or the vamp, but the stripes can be shifted in place to vary the color or design for the shoe upon which they are applied.

The invention primarily contemplates the adaptation of various segments of footwear, such as running or walking shoes, or even footwear in general, or sandals, or related shoes, such as athletic shoes, boots, skates, and the like, to provide for the locating of a stripe changing mechanism thereon, whether it be integrated into the structure of the shoe, or simply surface applied, to provide for changing of the coloration or designs of one or more stripes, as provided in association with such footwear. For example, such stripes may be applied to the quarter portion of the shoes, the counter, the vamp, or even in the tongue, or elsewhere, and one or more sets of stripes may be located at one of these positions, and when shifted, can drastically vary the coloration for the shoe, through manipulation of the variable stripe. Stripes include generally a linear length of material, be it cloth, textile, vinyl, other polymer, nylon, and leather normally continuous in structure but the stripe can be turned, one direction or the other, to display different coloration characteristics, or aesthetics, as desired. A tab may be operatively associated with each stripe, and facilitate grasping thereof, so as to manipulate the stripe in either direction, as during shifting, to display whatever color or design is desired. As an example, the stripe may be fabricated of multiple segments of different colors, which may comprise the school colors for the wearer, so that the stripe can be manipulated to provide dual colors, of the school, or perhaps further shifted, for the display of just one of the colors, or the other. Further manipulation of the stripe may provide for display of the school mascot, or other design, or even the nickname for the school, or the school name itself, as may be desired. These are all examples as to how the stripes may be imprinted and manipulated, to vary the aesthetics of the shoe, upon which this invention is embodied. Or, the stripes may be appended to the exterior of the shoe, perhaps held in position by means of a pair of spaced apart rings, such as d-rings, which when moved, the stripes display various colorations, during their shifting.

Furthermore, a stripe may be located across the strap of a sandal, clog, or other related type of beach shoe, and the stripe can be shifted, to change or vary the color of such a strap, during its application.

The stripe may also comprise a belt like structure, held at its ends by means of a buckle, with the stripe itself having different coloration, on both its external and internal surfaces, so that the stripe can be shifted to vary the coloration of the shoe to which it is applied, or the stripe may be pivoted or twisted, or turned over, to afford the presence of additional coloration. In an alternative the stripe may be simply pivoted, at various segments, to furnish other coloration to the footwear.

In addition, the quarter portion of the shoe may include a series of stripes, which may comprise shiftable segments, such as of polymer, or the like, providing a viewing window through which the stripes may be viewed, but that the segments can be shifted, upwardly or downwardly, relative to the shoe, to provide different coloration and appearance. These are examples as to how the stripe concept of this invention, whether it be individual stripes, segmented stripes, shiftable segments, all may be embodied or integrated into the structure of a shoe, and be moved, to display different colors or designs, upon shoes.

It is, therefore, the principal object of this invention to provide means for varying the coloration and design of footwear by shifting of stripes integrated into the structure of the footwear.

Another object of this invention is to provide the use of stripes that may be shifted, turned, pivoted, or otherwise moved, to vary the aesthetics of the surface of the footwear.

Still another object of this invention is to provide means for varying the coloration upon running shoes, jogging shoes, walking shoes, dress shoes, sandals, slippers, clogs, beach shoes, and the like, to provide for color and design variation for in their aesthetics.

Yet another object of this invention is to provide various changeable stripe(s) that may be applied to athletic shoes, at various locations, in the various structural assemblages as for this invention, wherein such changeable stripe(s) can be located singularly upon the athletic shoe, or perhaps upon the vamp, quarter portions, the counter, or even high up singularly or in series, at different angles, upon the upper quarter portion of high top basketball shoes.

Still another object of this invention is to provide a changeable stripe that can applied to a work shoe or boot.

Another object of this invention is to provide means for facilitating the variation in coloration and design for shoes by providing integrated tabs that allow for grasping, and physical movement of footwear embodied stripes or shifting segments.

Another object is to provide a changeable stripe for use upon footwear, which may not include any type of tabs, but which stripe may be physically disposed in a manner that allows for grasping of one area of the stripe, and provide for its forceful shifting, simply by moving the front of the stripe upwardly or downwardly relative to its mount upon the said footwear.

A further object is to provide changeable stripes for applications to footwear, and which stripes may be fabricated of textile, leather, canvas, nylon, cloth, any polymer, can be varied with decorative design, coloration, or the like, to change the appearance of the footwear to which they are applied during usage.

These and other objects may become more apparent to those skilled in the art upon review of the subject matter of this invention, as summarized herein, and upon undertaking a study of the description of its preferred embodiment, in view of the drawings.

BRIEF DESCRIPTION OF THE DRAWINGS

In referring to the drawings, FIG. 1 provides a side view of a shoe having a singular changeable stripe applied at its approximate quarter portions.

FIG. 14 shows a changeable stripe applied to the integrated strap of a sandal, or the like.

DESCRIPTION OF THE PREFERRED EMBODIMENT

Figure 1:
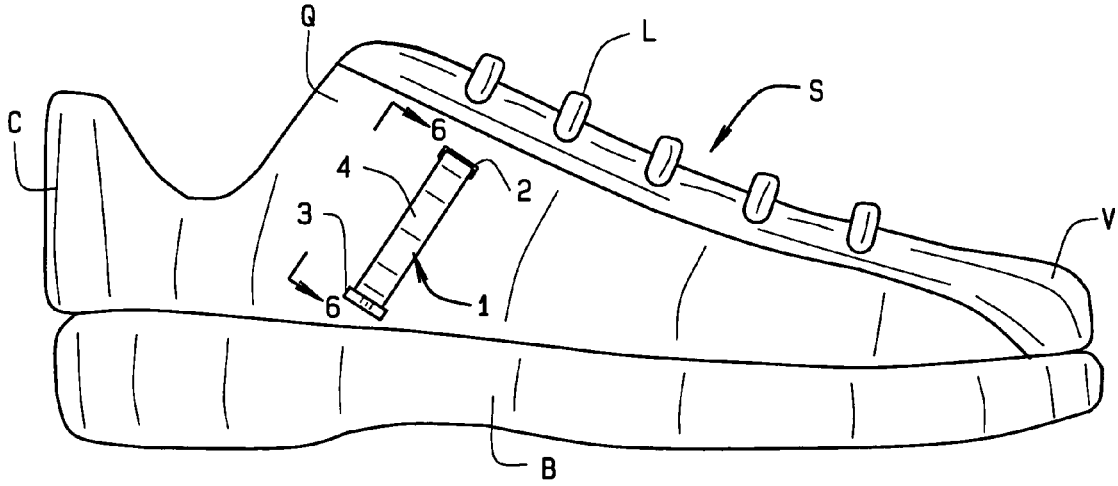
Figure 2:
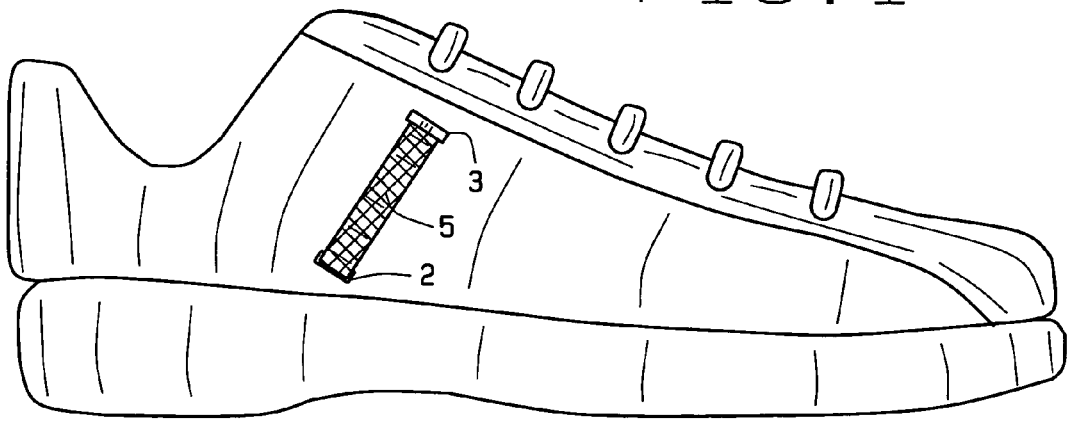
FIG. 2 shows the same stripe of FIG. 1, but the stripe, through its tab, has been shifted upwardly to change the design.

In referring to the drawings, and in particular FIG. 1, this invention is readily disclosed. It incorporates, in this particular embodiment, a changeable stripe 1 of this invention, applied along the quarter portion of its design. Obviously, such a stripe, formed as a band, can be located anywhere on the shoe, upon the opposite quarter portion, the counter, the vamp, either vertically, horizontally, of to other angulations, or in a series or plurality of such clustered stripes as to be subsequently described. In any event, the shoes shown are of the standard type, in this particular instance, a running or jogging type of shoe, having its quarter portion Q, its counter area C, vamp V, the base or sole B, and having lacing L that is required for holding the shoe together, on the foot, once the shoe is applied. The changeable stripe 1 is of the type that is integrated into the structure of the shoe, as will be subsequently described, wherein the stripe, in this instance, is continuous, and inserts through slots 2 provided above the upper and lower ends of the stripe, and further includes a tab 3 secured with the stripe, at a particular location, and upon grasping of the tab 3, the user can shift the stripe upwardly, or downwardly, at least a half-turn, to provide for disclosure of different segments of the stripe 1, so as to provide, for example, a first color, as at 4, but that when the tab and stripe is shifted upwardly, as can be seen in FIG. 2, different coloration or design is disclosed on the surface 5, as noted. Obviously, when the stripe and tab are arranged in the position as shown in FIG. 1, a first half of the stripe is shown. When the tab and stripe are shifted upwardly, this pulls the stripe from within the shoe, towards the outer surface, and displays the surface 5, as can be seen in FIG. 2. This is an example as to how the changeable stripe in this invention can be applied, for displaying different colorations, designs, and the stripe can be shifted a full or half turn, by pulling the tab 3 from the upper edge, to the lower edge of the shoe, as can be understood, or the tab may only be slid half way down the shoe, and thereby disclose one half of each segment of the changeable stripe, on the exterior surface of the shoe.

Figure 3:
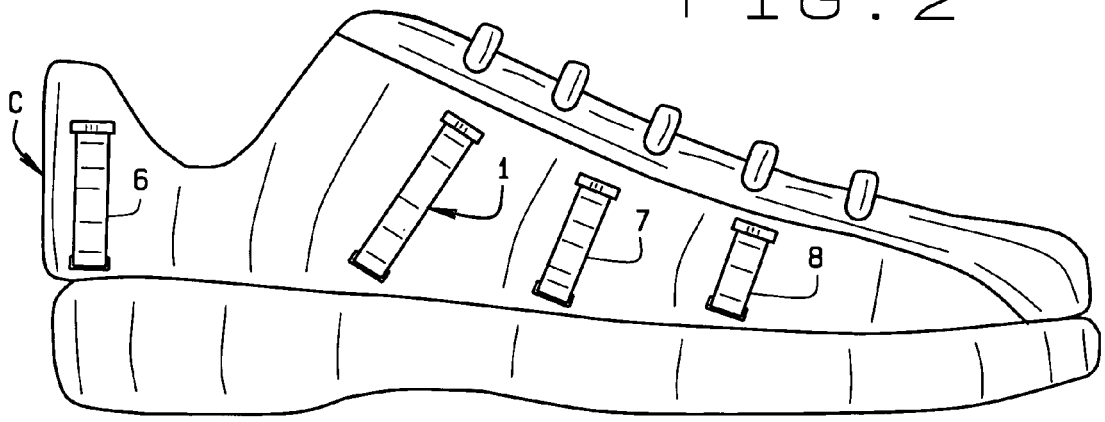
FIG. 3 shows a side view of footwear, having a series of the changeable stripes applied thereto.

A similar type of embodiment for the changeable stripe of this invention can be seen in FIG. 3. As disclosed herein, in addition to the changeable stripe 1, fabricated very similar to the manner which the stripe was applied to the shoe as explained in FIGS. 1 and 2, in this particular instance, there are additional changeable stripes affixed, with the stripe 6 being located generally in the back area of the shoe, at proximate its counter portion, of the changeable stripes 7 and 8 or located more forwardly, upon the frontal quarter portion, or the lower side vamps for the shown shoe.

Figure 4:
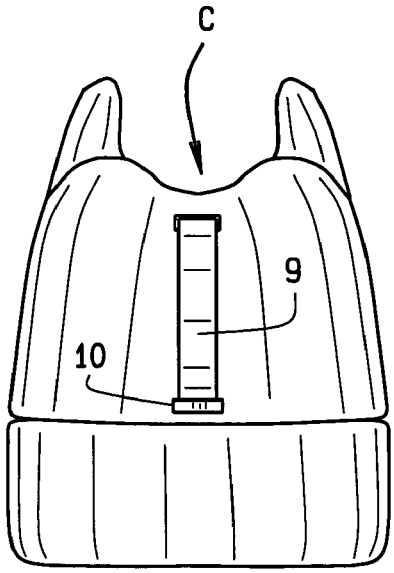
FIG. 4 shows a back view of footwear, having a changeable stripe applied to its counter.

FIG. 4 shows how the changeable stripe is applied directly at the back end of the counter C of the shown shoe. This is the changeable stripe 9, as disclosed. The changeable stripe 9 will be integrated into the shoe structure similarly to that as previously described for the stripe 1. In addition, it can be arranged vertically, horizontally, or at an angle, as desired. In addition, at this location, the value of the changeable stripe of this invention can be readily determined. For example, when the tab 10 is arranged downwardly, the changeable stripe may have a coloration similar to the overall pattern for the shown shoe. But, when the tab 10 is elevated upwardly, a different coloration may appear, such as, for example, the cautionary bright orange that is frequently applied to clothing, particularly for joggers, so as to allow them to display a caution, particularly in the evening, or night, when jogging, so automobile headlights, or the like, will be reflected therefrom, to caution any driver as to the presence of a jogger, for safety purposes.

Figure 5:
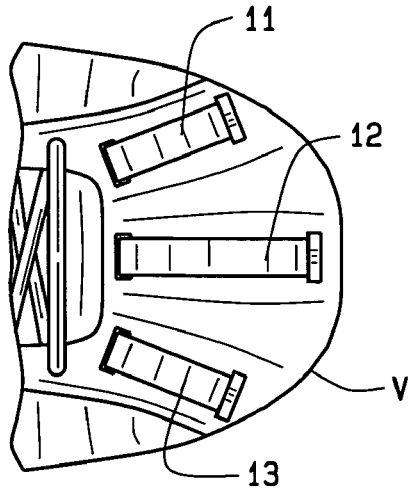
FIG. 5 shows a top partial view of footwear, showing a series of changeable stripes applied to its upper vamp.

FIG. 5 shows how a series of the changeable stripes 11 through 13 may be applied to the upper frontal vamp portion V on the shown shoe.

Figure 6:
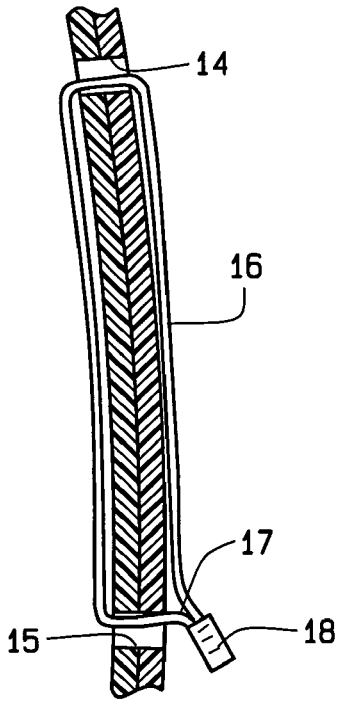
FIG. 6 provides a side sectional view of footwear, showing the stripe integrated into the structure of the shoe, as taken along the line 6-6 of FIG. 1.
Figure 7:
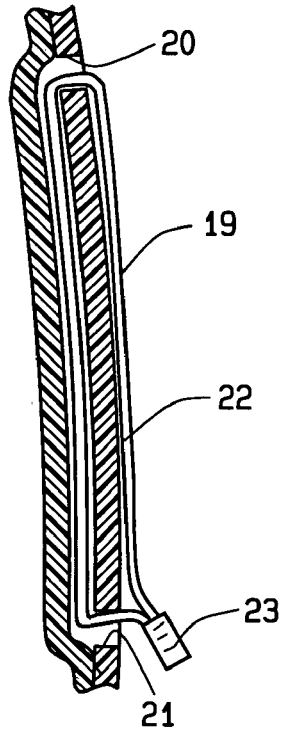
FIG. 7 shows how the changeable stripe can be integrated through at least the outer surface layer of the quarter portion of the shoe of FIG. 1.

FIGS. 6 and 7 disclose different methods for integrating the structure of the changeable stripe into the shoe structure. For example, as can be seen in FIG. 6, the slots 14 and 15 may be applied through the entire structure of whatever segment of the shoe upon which the changeable stripe 16 is applied. The changeable stripe, as can be seen, is a length of material that is continuous in structure, with its ends 17 held by the shown tab 18, the tab 18 being useful for grasping by the wearer, so that it can be pulled upwardly, or downwardly, to shift the stripe 16 during its application and usage. FIG. 7 shows how the adjustable stripe 19 can locate through slots 20 and 21, fully formed through the outer layer or surface 22 on the shown shoe. Once again, the tab 23 can be pulled upwardly, or downwardly, to shift the stripe, and to change its coloration or design in order to vary the aesthetics of the footwear, through the usage of the assembly of this invention. Obviously, where the various slots 14, 15, 20, and 21, are applied, through the various layerations of the shoe, any of those metal or polymer grommets may be applied through the slots, in order to ease the shifting of the changeable stripes, and to prevent tearing of the layers of the shoes, proximate the location of such slots, particularly after prolonged usage and wearing of the shown shoes.

Figure 8:
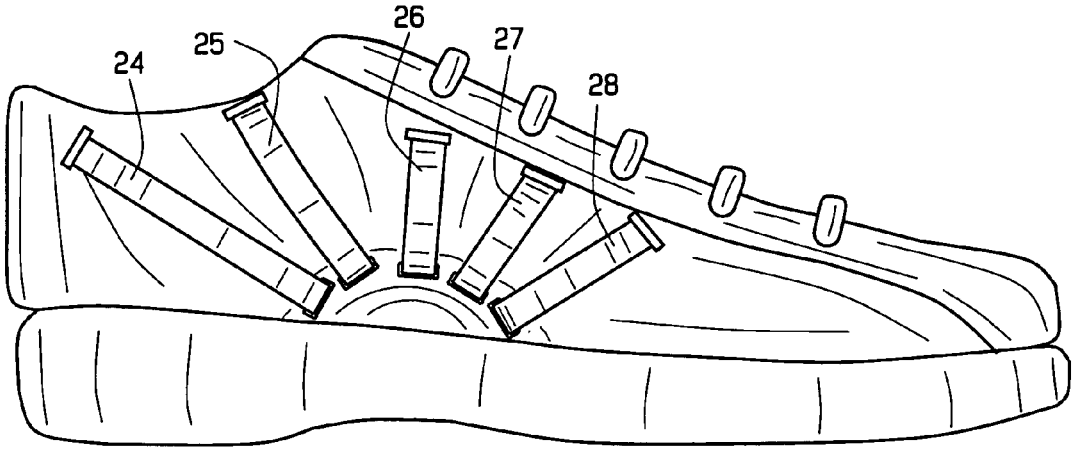
FIG. 8 shows a series of stripes applied to the side of the footwear and arranged in a radial fashion to provide for multiple color changes through shifting of the stripes of the shown shoe.

FIG. 8 discloses how the changeable stripes 24 through 28 may be applied in a radiating pattern along the quarter portion of the shown shoe.

Figure 9:
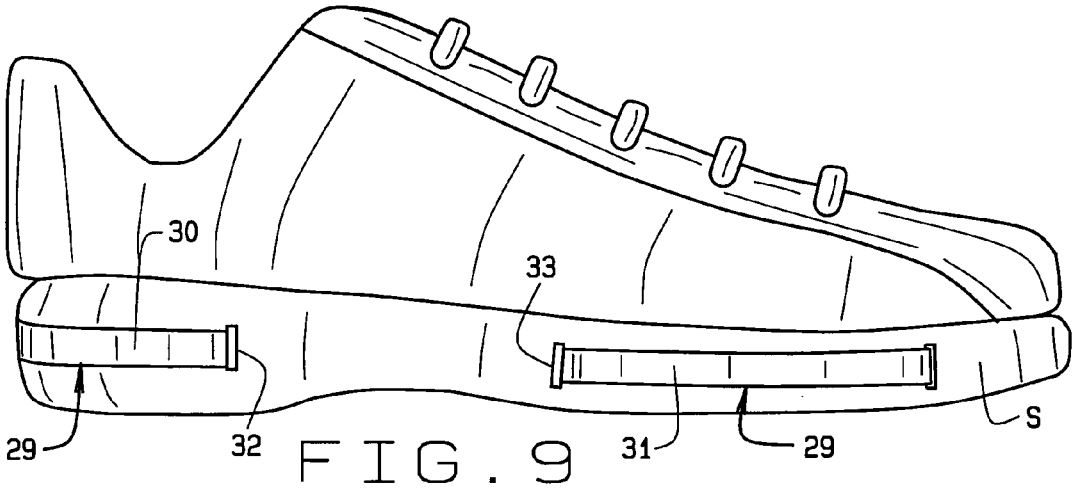
FIG. 9 shows how stripes may be integrated into the sole portion of the shown shoes.

A further variation upon the usage of the stripes of this invention can be seen in FIG. 9. As disclosed, in this particular instance, the changeable stripes 29 can be applied along the sole or base structure S of the disclosed shoe. These particular structures may be integrated into the molding of the shoe, so that slots will be provided inwardly thereof, for locating of the changeable stripes 29 therein, or their back segment, while the front segments 30 and 31 can be arranged externally, as can be noted. Or, such stripes may be applied as a surface application, as to be explained in FIGS. 10 through 13, of this disclosure. Nevertheless, a pulling of the respective tabs 32 and 33 allows the stripes to be changed, a half turn, in order to change the coloration or the design as displayed upon the surface of said stripes.

Figure 10:
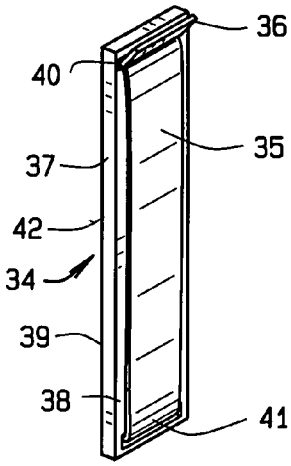
FIG. 10 shows a singular stripe, and its adapter, for holding the same, and which can be stitched, or adhesively applied, or otherwise secured to a surface, or integrated into the structure of a shoe.
Figure 11:
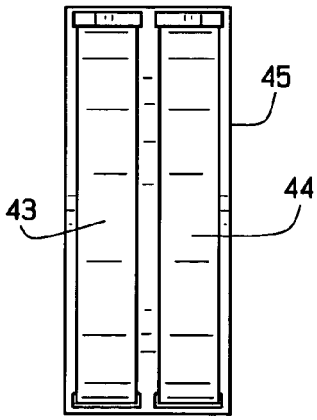
FIG. 11 shows a double changeable stripe.
Figure 12:
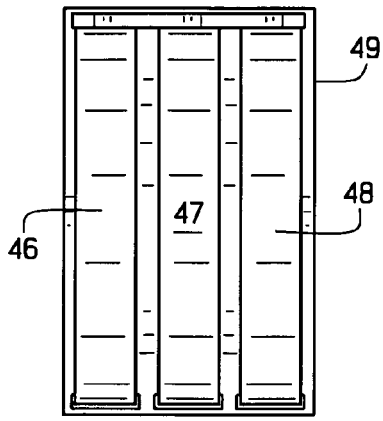
FIG. 12 shows a triple changeable stripe.

FIGS. 10 through 12 disclose an adaptation to this invention. As can be seen in FIG. 10, the changeable stripes may be fabricated as a unit, as at 34, which may include the changeable stripe 35, and its pull tab 36, that allows the stripe to be changed a half turn, upon shifting the tab from top to bottom, or vice versa, during usage. The adapter or base 37 for the changeable stripe is a semi enclosed unit, having a front wall 38 and a rear wall 39, with slots 40 and 41 provided through the front wall, so that the changeable stripe can be located therein, providing one-half surface of the stripe being disclosed exteriorly, as can be seen at 35, while the other half of the stripe arranges internally of the base 37, during usage. Pulling the tab 36 downwardly exposes the other half of the changeable stripe, during application. In addition, an adhesive, such as a double pressure sensitive adhesive will be applied, as at 42, to the back surface of the base 37, so that the unit can be applied directly to the surface of the shoe, at any location. Or the adapter can be stitched in place. Furthermore, it is preferred that the base, and the entire unit, will have sufficient flexibility so as to allow it to be curved and conformed during its application. Thus, the base may be formed of relatively thin plastic components, when constructed, to allow for it to be shaped, as desired. In addition, there may be a slight rim extending from the base 37, and that rim could be stitched to the shoe, or applied by other methods, directly to the surface of the shoe, whatever surface component of the shoe the changeable stripe is applied. It is also likely that this type of a stripes unit, shown at 34, could also be integrated into the structure of the shoe, such as stitched in place between the inner and outer liners, as shown in FIG. 7, and provided an opening through which the stripe itself can be reviewed and manipulated.

FIG. 11 discloses how a pair of such changeable stripes, as at 43 and 44, structured in the same manner as the changeable stripe 35, can be assembled into a singular base structure 45. Once again, it is desired that the base structure will have sufficient flexibility so that the compound stripes can be applied to any surface of the shoe, even though it may be along a curve, such as along the quarter portions, upon the vamp, at the counter, or even perhaps horizontally along the sides of the soles, as explained.

FIG. 12 shows how triple changeable stripes 46 through 48 can also be applied to the base or adapter 49. Obviously, any number of changeable stripes, within reason, can be assembled within a base, such as shown herein, for application to footwear. It might also be stated that these types of stripes, particularly when in the unit form, as shown in FIGS. 10 through 12, may be applied to other types of clothing, such as shirts, caps, coats, or even to the side of a purse or backpack, at the desire and wishes of the user or owner.

Figure 13:
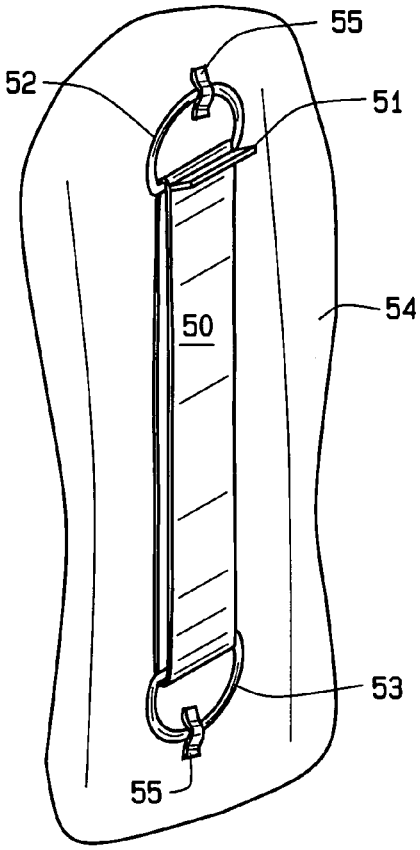
FIG. 13 discloses a singular changeable stripe held by D-rings to the outer surface of a shoe.

FIG. 13 shows another variation on the method of installation of the changeable stripes of this invention. As can be seen, the ends of the stripe are held together by the tab 51. In this particular instance, the changeable stripe is held in position, for shifting, by means of a pair of D-rings 52 and 53, and the D-rings can be fastened to the sides or other components of footwear, clothing, a handbag, or the like, as noted at 54. D-rings or other types of holding devices 52 and 53, such as other shaped rings or buckles can be secured by means of a stitch, clip, or other means of fastening, as at 55, to the surface of the item to which it is applied. Simply pulling the tab 51 downwardly will shift the changeable stripe 50, a half turn, which will allow for exposure of its opposite or back surface, to the front of the item of clothing, as can be understood.

It is just as likely that the style of changeable stripes, as previously described, are the unit stripes as shown at 34 and FIG. 10, et al, or even the stripe 50 as held by the D-rings, or other holders, could also be placed anywhere upon the sole of the shoe, such as laterally around its mid-sole, or even around its heel portion, or at the front toe of the shoe.

Figure 14:
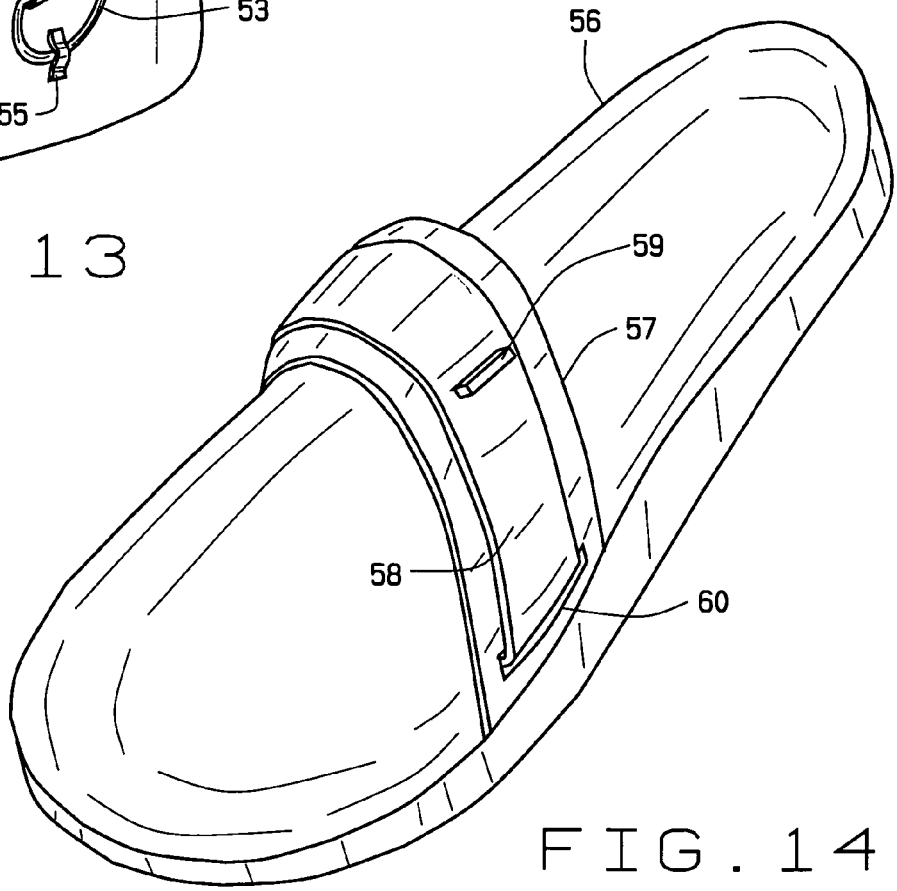

FIG. 14 shows how the changeable stripe of this invention can be applied to a sandal, beach shoe, clog, or the like. Additionally, when structured, the beach shoe 56 normally has an integral strap 57 extending from side to side, as can be noted. The changeable stripe 58, with its pull tab 59 inserts through slots 60, one provided on either side of the shown strap 57, and may either extend to the interior of the shown strap 57, or pass through its laminar structure, if it is formed of laminar material. Nevertheless, pulling of the tab 59 in one direction or the other, allows for changing of the surface presence of a segment of the stripe 58, so that different colorations, designs, or the like, can be disclosed, during usage. For example, the underside of the stripe could pass through the laminar structure of the shown strap or vamp 57, or it may pass all the way through such a strap, and be held contiguous to the interior surface of the strap, through the usage of any type of sleeve, loops, or any other similar type structure that will hold the inner stripe in place. Furthermore, since in many instances, in the structure of a beach shoe, or the like, the vamp 57 may have substantial width, from front to back, it may be that a plurality of such changeable stripes could be located thereon, either longitudinally or in parallel, in the manner as described herein, so as to allow for multiple variations of designs or colors upon the surface of the beach shoe, or the like, when employed. It is also likely that instead of using a continuous stripe, which extends through the shoe, D or other type rings, as shown in FIG. 13, may be applied to the lower margins of the shown integral strap 57, with a continuous stripe extending over the exterior surface of the strap, when applied, and used.

Figure 15:
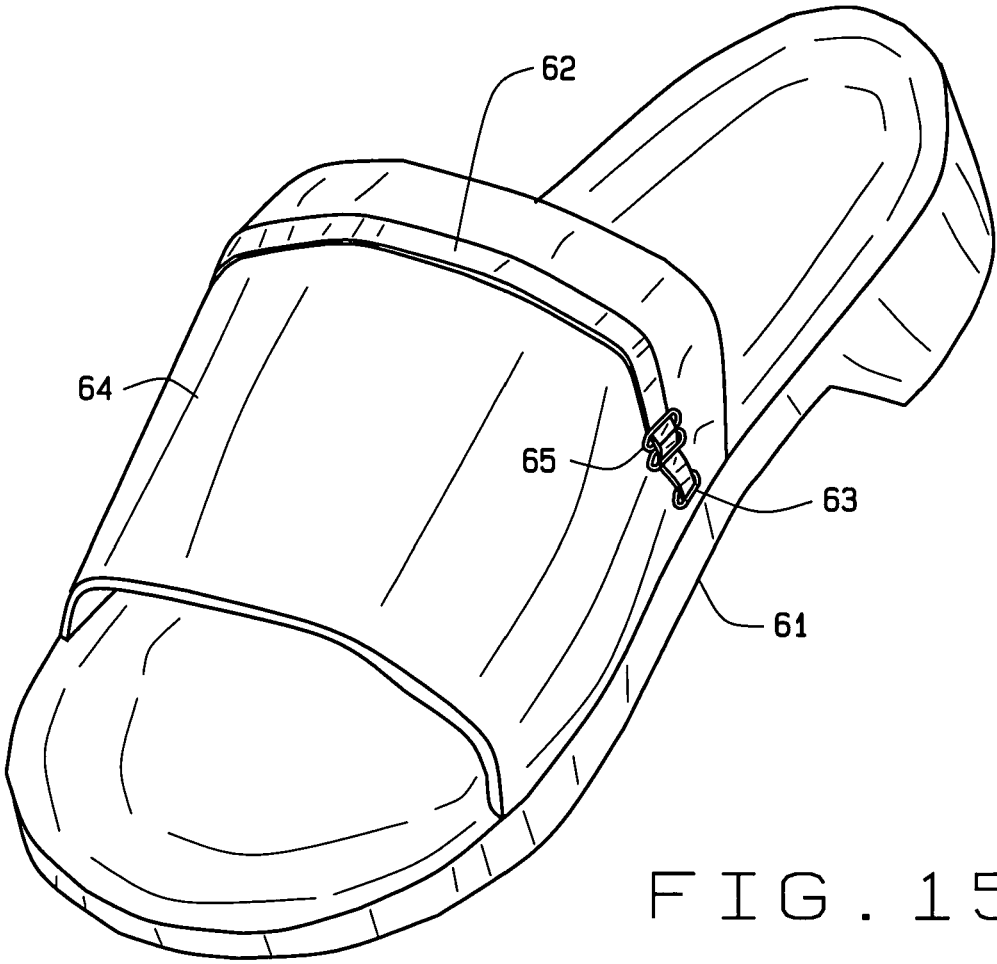
FIG. 15 shows another changeable stripe, which may be shifted, turned, pivoted, or simply has its buckle opened, and turned over, to display different variations in color and design.
Figure 16:
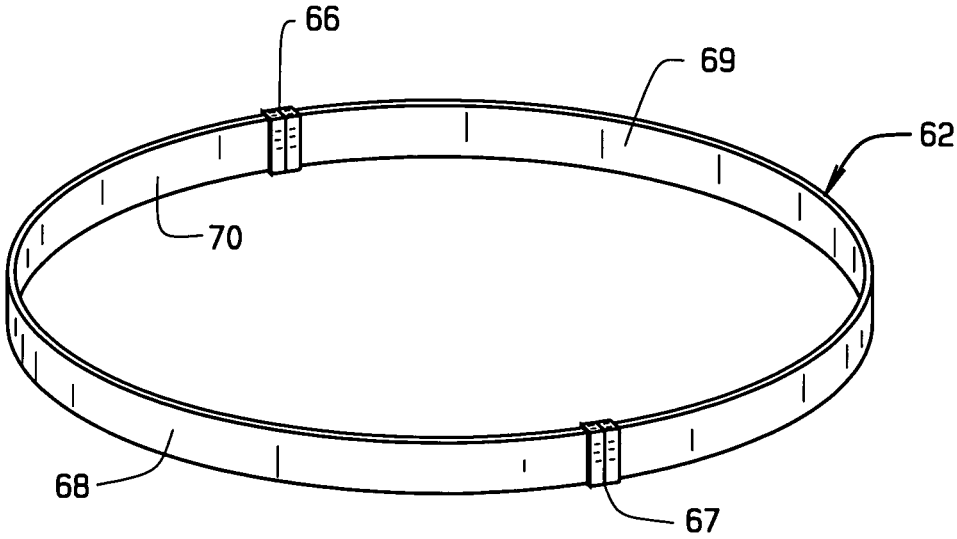
FIG. 16 shows the changeable stripe of FIG. 15, and disclosing where the stripe may be pivoted, at pivot points, when assembled into a shoe.

FIG. 15 shows a variation upon the usage of the changeable stripe of this invention, upon a related type of shoe structure. The shoe, as shown at 61, comprises a sandal, or the like. The changeable stripe 62 extends through slots 63, one provided to either side of the vamp portion 64, on the shown sandal. The changeable stripe may be held at its ends, by means of a buckle or clasp 65, as noted. Thus, upon pulling the buckle 65 upwardly and across the vamp 64, the different segment of the changeable stripe 62 will be exposed exteriorly, and can provide for changing of the aesthetics of the stripe, relative to the shoe, upon which is it applied. It can also be seen in FIG. 16, the changeable stripe 62 can be formed of a pair of halves or more, being linked as at the connectors 66 and 67 at various ends of the said stripe. Hence, the connecters 66 and 67 are pivotal relative to each other, so that a segment of the changeable stripe may be rotated to expose an inner surface, during usage. For example, the changeable stripe 62 is formed of the two stripe segments or more, as noted at 68 and 69. Thus, upon pivoting of the stripe 68, relative to the connectors 66 and 67, the inner surface 70 of the stripe can be disclosed exteriorly. Hence, during usage, as applied into the sandal, in lieu of the stripe 62 variations upon the colorations or designs provided upon the surface of the sandal can be obtained, by not only shifting the stripe 62 over the surface of the vamp 64, but likewise, it can even be turned, inside out, in the manner as previously described, to provide a different visually appearing portion of the stripe, externally of the sandal, during usage. Obviously, more than two segments for the changeable stripe 68 and 69 may be made for the stripe 62, as for example, there may be three of more types of segments formed into the stripe 62, with the similar type of connectors, as those as shown at 66 and 67, along its length, to allow for segmental pivoting of parts of the changeable stripe during its usage and application.

Figure 17:
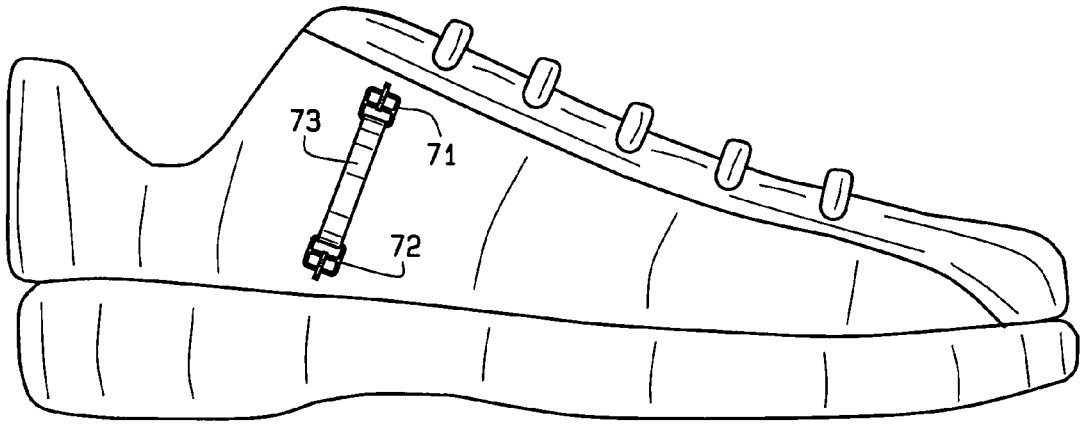
FIG. 17 shows a stripe having buckles for holding the changeable stripe in place.

FIG. 17 shows how a pair of buckles, or the like, as at 71 and 72 may be applied to the surface of the shown shoe, with the changeable stripe 73 applied to their proximate rings, as can be noted, and the stripe can be pulled, for shifting, relative to the buckles, during usage. Obviously, the use of these types of buckles is not too unlike that as previously explained with respect to the application of the D-rings, or other types of rings, as at 52 and 53, as previously explained with respect to the changeable stripe shown in FIG. 13.

Figure 18:
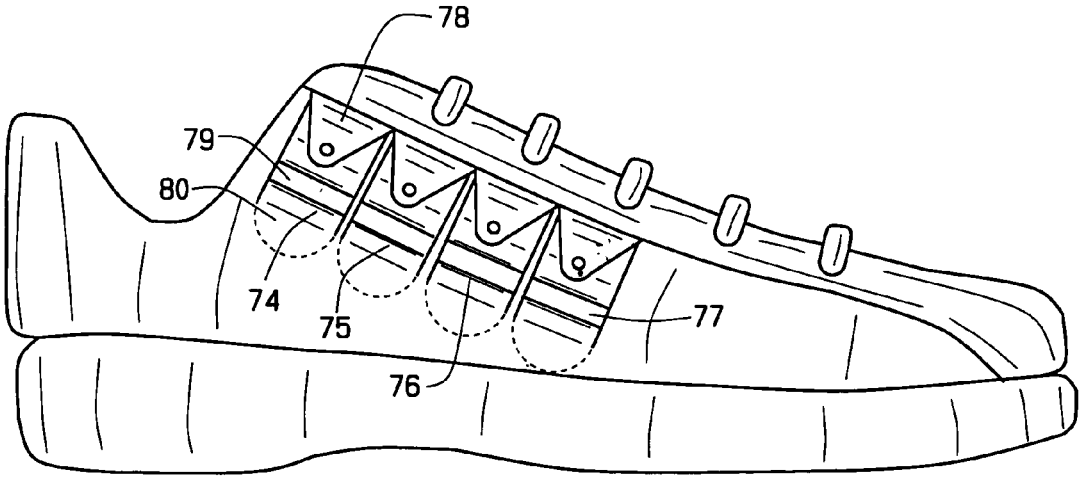
FIG. 18 shows a series of one or more sleeves, applied to the quarter portion of the side of the shown shoe, and which may contain slide type segments that can be shifted to change the coloration of the shown shoe.

FIG. 18 shows yet another modification and variation upon the changeable stripe pattern of this invention. In this particular instance, there may be sleeves, such as the four sleeves 74 through 77 applied to the surface of the shoe. The sleeves may have closures, as at 78, upon their upper, or perhaps lower, edges. A segment of the sleeves may have an opening, or be transparent, as noted at 79. Shiftable segment of a card, polymer, or the like, as at 80, may be located within each sleeve and upon shifting upwardly, or downwardly, within the sleeves, may disclose a different coloration or design through the window 79, as can be understood. This is to disclose how different types of colorations or designs can be added to the surface of the shoe, in this particular instance, along its quarter portion, so as to vary the aesthetics of the footwear, during usage.

Obviously, the sleeves as provided upon the shoe may or may not have the type of closures, as shown at 78, structured thereto, but simply embody the changeable stripes within the described sleeves 74 through 77, so as to provide for the showing of their different colors or designs, upon shifting therein.

Figure 19:
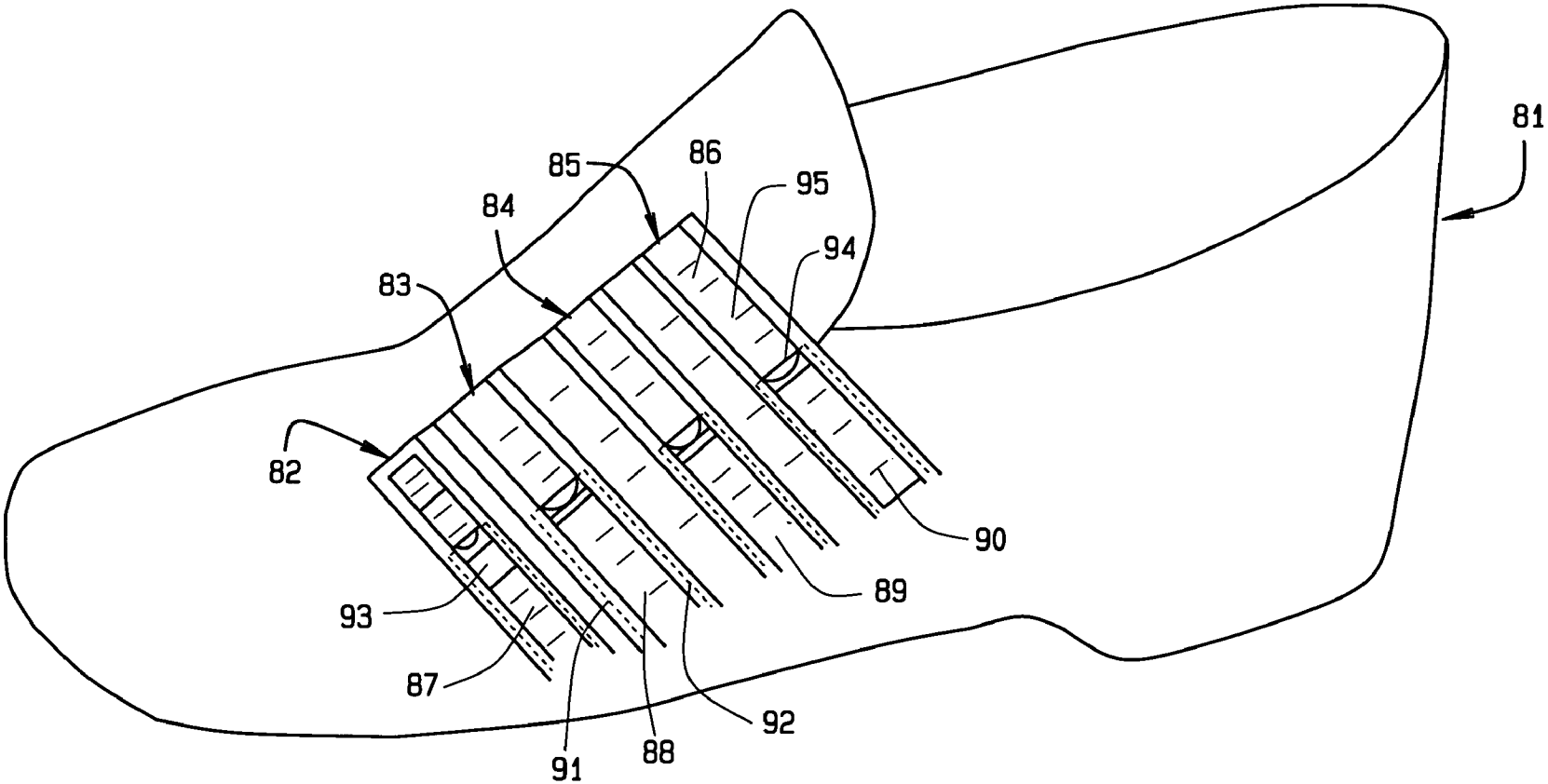
FIG. 19 shows the application of one or more shiftable stripe(s) or slides that can be located within sleeves provided upon the surface of footwear, such as along its quarter portion, as shown therein.

FIG. 19 discloses another variation upon the usage of the changeable stripes of this invention. As noted, 81 can contain a series of sleeves, as at 82 through 85, and these sleeves will have opened fronts, as at shown at 86, so that the colored or designed slides 87 through 90 may be located therein, held in position by means of the edging, as at 91 and 92, provided upon each open sleeve. Thus, the upper part of the sleeve, or the bottom of the part of the sleeve, or a central part of the sleeve, as can be seen in 93, may remain opened. Then, upon pulling of one of the tabs 94, the stripe may be pulled upwardly, for disclosing a change in coloration, as the slide appears upwardly within its opened sleeve, such as shown at 83. Or, where a window 93 may be provided within the sleeve 82, variations and colorations or designs for the underlying stripe 87, may appear within the window, to add or change the coloration of the shown shoe. This can be done, individually, for each of the stripes 87 through 90, applied within their respective sleeves 82 through 85. In addition, as for example with respect to the stripe 90, within its sleeve 85, when its tab 94 is slid all the way downwardly, along the quarter portion of the shoe, as shown in FIG. 19, a colored surface of the shoe, as at 95, may appear and be disclosed to the viewer. But, as the tab 94 is pulled upwardly, either partially or fully, up to the lacing area of the shoe, its slide 90 likewise comes upwardly, to provide a different coloration or design overlying the surface 95 of the shown shoe, to change the aesthetics.

Figure 20:
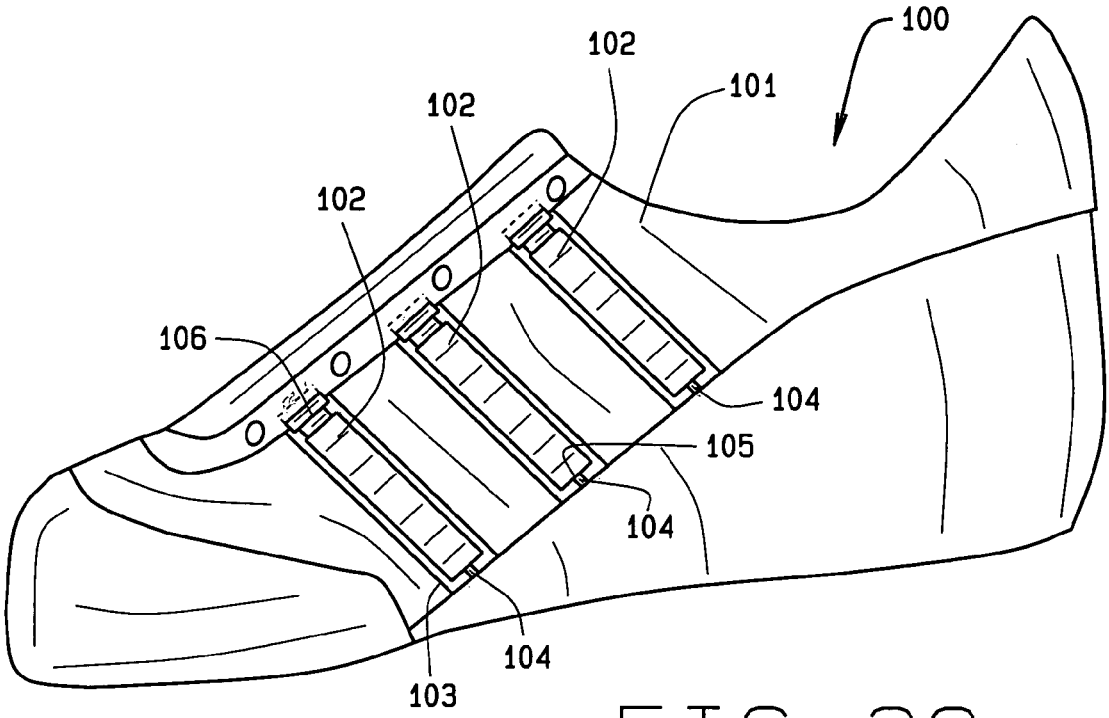
FIG. 20 shows a side view for the shown footwear having reversible changeable stripes applied thereto.

The further embodiment for the stripe changes concept for this invention can be seen in FIG. 20. As noted, the shoe 100 includes a side or quarter portion as at 101, and incorporates the stripe changing concept of this invention. As can be seen, there are a series of three stripes, as at 102, and which are secured in proximity with the surface of the shoe quarter portion, in order to display at least one surface of the stripe 102, as can be noted. But, the stripe is capable of being turned, or changed, in order to display a differing indicia, coloration, or trademark or name, upon the striped surface, during usage. For example, each stripe is located upon or in contiguity with a grooved segment 103 formed into the surface of the shoe, or the stripe may simply rest in contiguity against the surface of the shoe quarter portion, when used. Nevertheless, each stripe 102, at one end, will provide means for turning of the stripe, and in this particular instance, as can be seen at the bottom of each stripe, a turning device, as at 104, is provided. This may comprise either a swivel, of the type as previously explained in our U.S. Pat. No. 6,574,887, which was patented on Jun. 10, 2003, or it may provide for any other type of means for turning of the stripe, such as a cord, elastic member, or the like. Such a swivel or elastic member will be secured or otherwise stitched into the construction of the shoe, at one end, and attach, at its other end, such as to the bottom of the stripe, as at 105. Then, the upper end of each stripe incorporates a snap clasp, as at 106, which may be either a snap button or clasp, or it can be one of the slide type locking mechanisms that once inserted into its base, becomes fixed, to hold the strip 102 in place. Or, such a slide lock may be removed, to provide for turning of the stripe, either fully along its length, or partially, in order to display some additional or other indicia, design, word, or the like, as previously explained.

Figure 21:
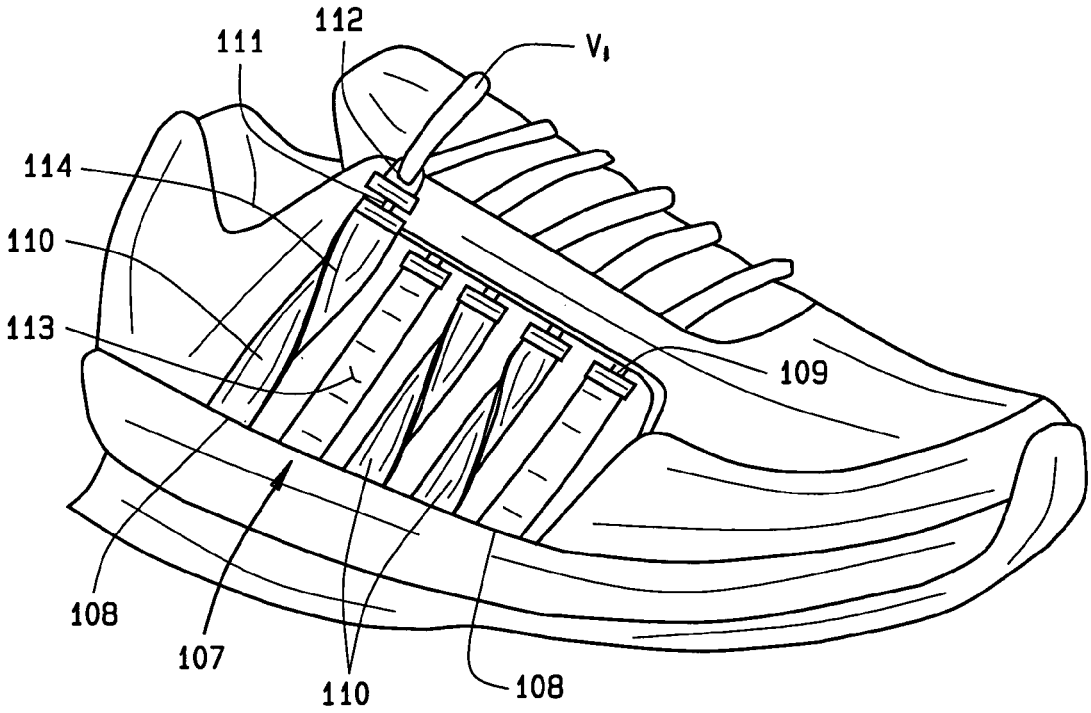
FIG. 21 shows changeable stripes that are twistable in their configuration when applied to the quarter portion of footwear.

In referring to FIG. 21, it can be seen where the stripes 107 can be affixed at their bottom and to the structure of the shown shoe, as noted at 108, while the upper end may include some form of a swivel, or locking mechanism, the type as previously explained, as at 106, or simply incorporate an elastic or other type of cord, as at 109, so the stripe can be partially turned, as can be seen at 110, so as to display partial coloration from the back end of the stripe, when the stripe is twisted, as noted, in its placement within the structure of the shoe, as during usage. As can also be seen, one of the stripes, or all of them, at their upper end, may include a swivel means, as at 111, and which may contain an integral eyelet, as at 112, so that one of the lacings, as at $V_1$, may insert therethrough, and hold the stripe in place, after it either has been arranged in a lineal fashion, as can be noted at 113, or twisted, as can be seen at 114, as previously explained.

It is also likely for the embodiments of the shoes as shown in FIGS. 20 and 21, in lieu of the usage of elastic means, snap clasps, fixed fastening of the straps to the bottom edges of the shoes, as noted in FIG. 21, that other types of means for fastening could be applied, such as D or other type rings, to hold at least one end of the straps in place, when turned. Or, even in lieu of the snap clasp as shown at 106, a D ring or other type ring could be applied at that location.

Figure 22:
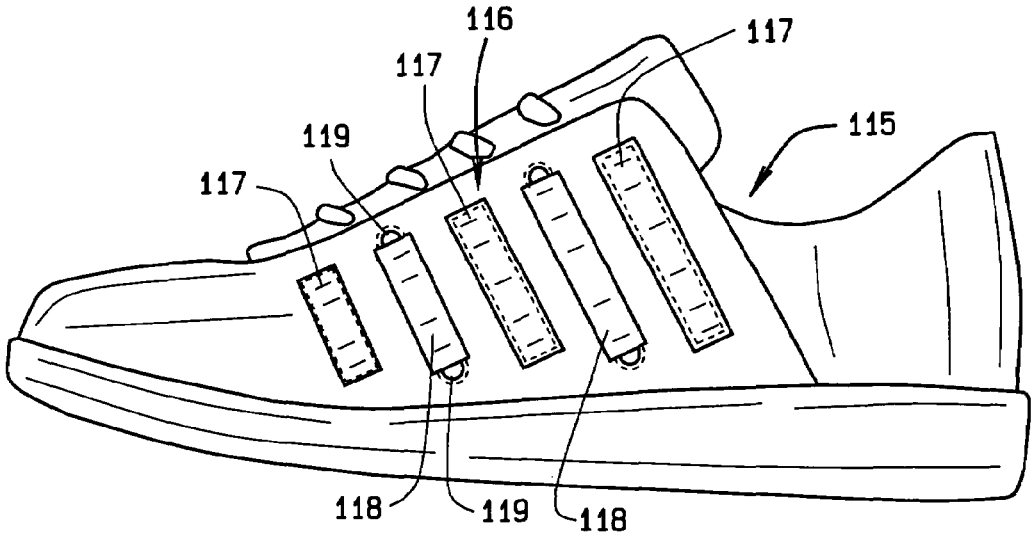
FIG. 22 shows further variations upon changeable stripe patterns as applied to a shoe.

FIG. 22 shows a further modification to the stripe change concept of this invention, as applied to footwear. As can be seen, the shoe 115, contains a series of stripes, as at 116, upon its upper quarter portion. As shown, select of the stripes, as at 117, may be either fixed stripes applied to the shoes, as part of its design, ornamentation, or trademark, or such stripes may be of the slide type configuration for the stripes when applied to shoes, as previously explained with respect to FIG. 1. Other of the stripes, as noted at 118, may have a swivel, as at 119, applied at each end, so that the stripe may be turned, to display whatever indicia is provided upon its opposite surface, when used. Obviously, under such circumstances, the stripe may have some minor elasticity provided to it, so that it can be pulled sufficiently clear of the shoe surface and turned, by way of the swivels, to achieve such manipulation.

Figure 23:
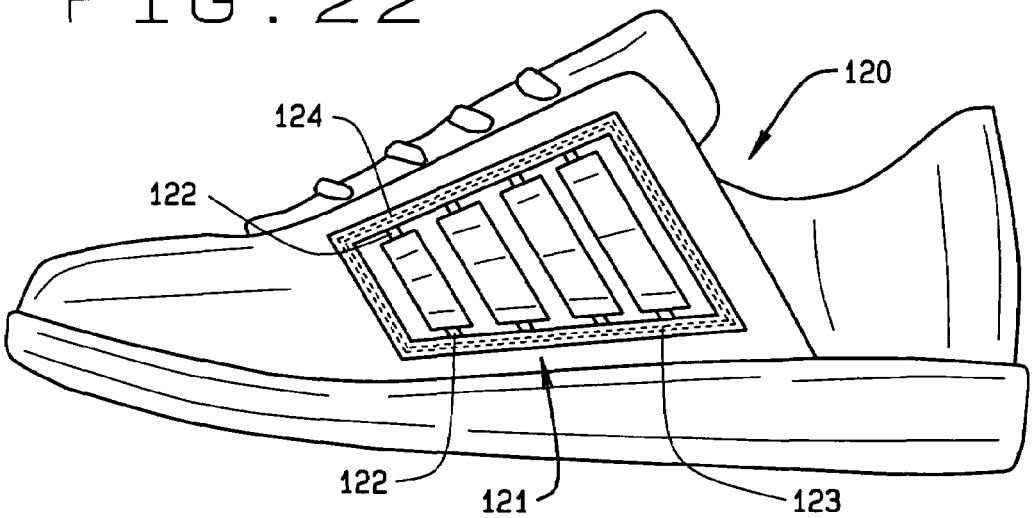
FIG. 23 shows how a packaged set of changeable stripes may be stitched or otherwise applied to the quarter portion of the shown shoe.

FIG. 23 shows another shoe, as at 120, wherein a series of stripes, as at 121 may be held in the position by means of a cord, elastic member, or the like, as can be seen at 122, and then be turned, to its opposite surface, when it is desired to change the design provided upon the stripe, as affixed to the shoe, as can be noted. For the entire system of the various stripes 121 as shown, there be any number of them as displayed, and may be embodied or fixed together within a perimeter frame, as at 123, and manufactured independently of a unit, and then stitched, as at 124, to the quarter portion of the shoe, when it is to be applied. This type of assembly, of forming the stripe or stripes in a kit form, can be used for application to any surface of the shoe, when the stripes are applied for their intended purposes.

Figure 24:
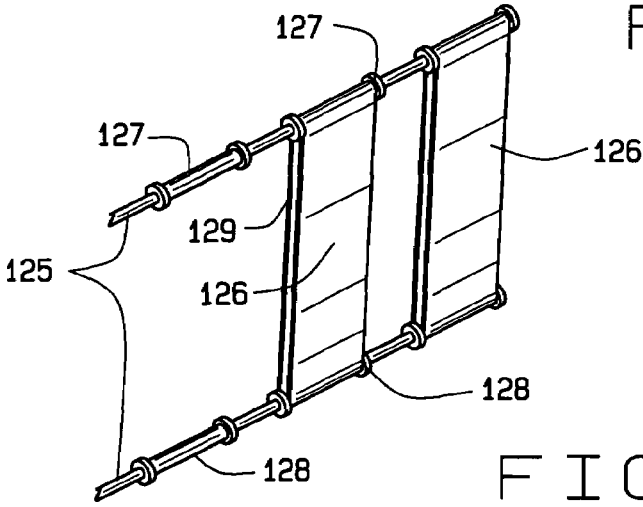
FIG. 24 shows how pivot rods may support continuous changeable stripes when applied to the quarter portion of footwear.

FIG. 24 shows a further variation on how the stripes may be applied to the surface of footwear. For example, for the kit as shown in FIG. 23, a pair of rods, as at 125 may be applied at the upper and lower edges of the perimeter frame 123, and have a series of the continuous stripes, as at 126, applied over spindles, at both the upper and lower edges, as can be seen at 127 and 128, and when it is desired to change the indicia displayed upon each stripe, to its back surface, as at 129, one needs simply to pull the stripe downwardly, or upwardly, until the back surface is rearranged into the front surface, at which time the surface 126, becomes the concealed back surface, through such a manipulation. In any event, this provides a means for a changing of the stripes, in accordance with the concepts of this invention.

Figure 25:
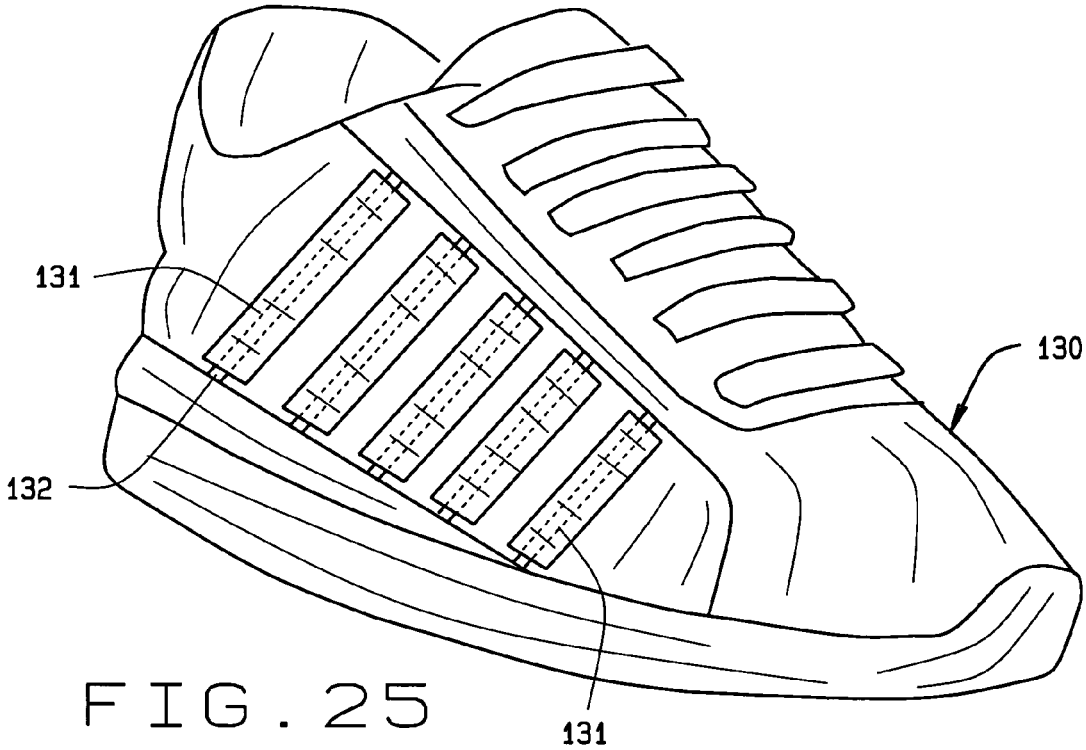
FIG. 25 shows how the changeable stripes may be formed as flaps and mounted upon spindles for reversal to change the appearance of the shown shoe.
Figure 26:
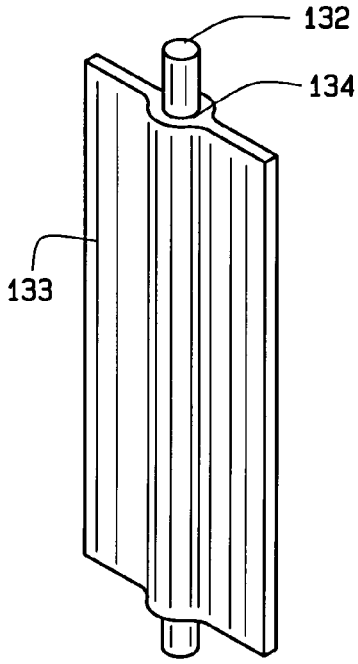
FIG. 26 shows one of the flaps and spindles for application to the shoe of FIG. 25.
Figure 27:
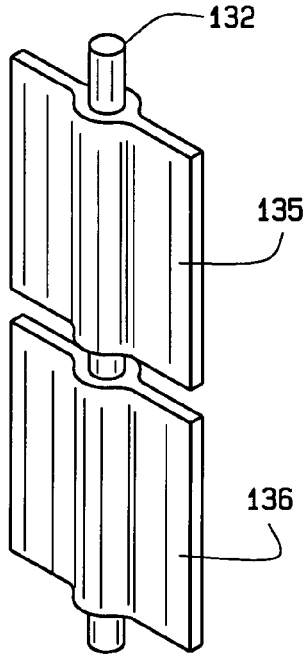
FIG. 27 shows a duel flap and spindle of type that may be applied to the shoe of FIG. 25.

FIG. 25 shows a further variation upon the concept of this invention. As noted, the shoe 30 has a series of stripes 131 provided adjacent the surface of the quarter portion of the shoe. As can be seen, in this instance, there are a series of spindles, as at 132, secured at their upper and lower edges fixedly into the structure of the shown shoe. Then, the stripes include a flap, as can be seen at 133, in FIG. 26, and which includes a central slot, as at 134, through which the spindle 132 locates. Stripe 131 is free to pivot about the spindle 132, when it is desired to show an opposite surface, for display, in the manner and for the purposes as previously reviewed. Or, as can be noted in FIG. 27, there may be a pair or more of such flaps 135 and 136 pivotally mounted upon the spindle 132, as a further variation to the manner in which the stripes may be displayed, upon their various surfaces, when applied and used upon the footwear, as can be noted.

Figure 28:
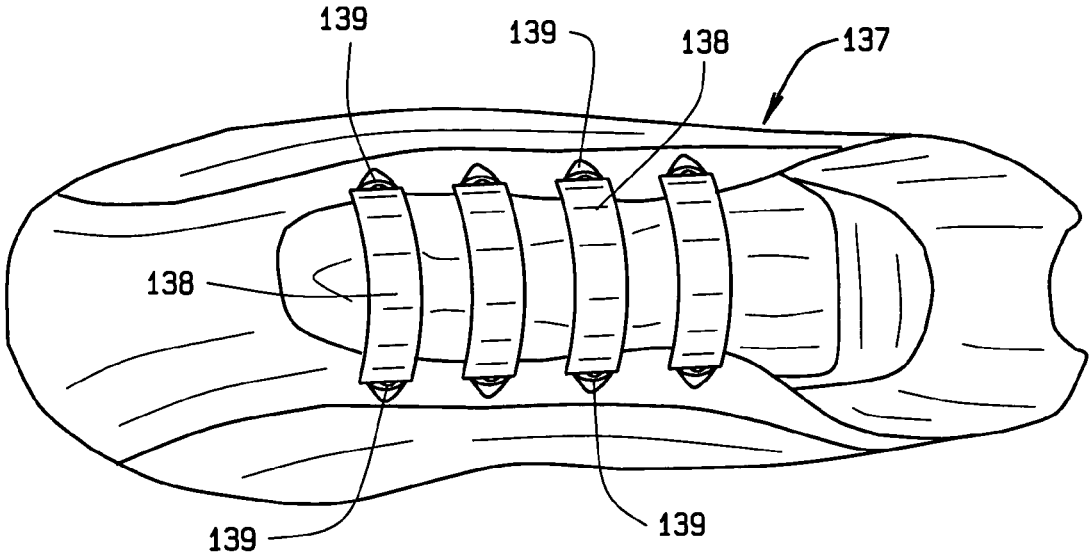
FIG. 28 shows changeable stripes that may be reversed as applied to the eye stays of the shown shoe.
Figure 29:
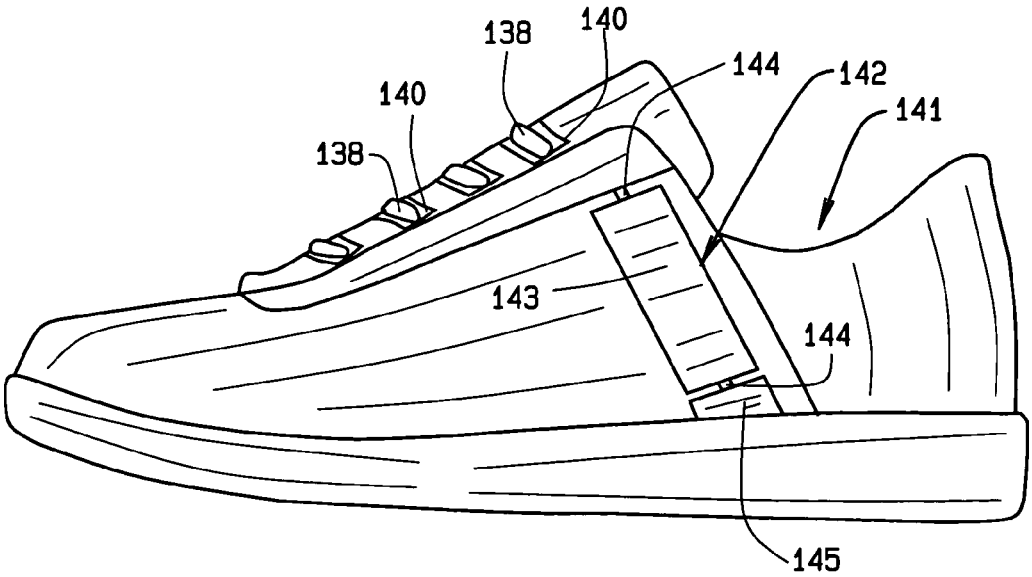
FIG. 29 shows a related shoe to that of FIG. 28 and further providing the combination of a changeable stripe applied across the quarter portion of the shown shoe.

FIG. 28 discloses a further variation upon the application of stripes to footwear. As can be seen, the shoe 137 includes a series of stripes, as at 138, which cooperate with the eyelets of the eyestay, or simply secure therewith, but yet can be turned, either through a swivel connection, or through the use of a cord or elastic at either end of the stripes, or through a clip, and thereby vary the appearance of the worn shoe. As can be seen, either swivels, as at 139, or perhaps even an elastic or other type cord, as at 140, (see FIG. 29), can be used for holding the stripes in place, but allow for their reversal, as desired, to display different coloration or indicia, as known. In addition, as can be seen upon the side of the shoe 141 there is a compound stripe, as at 142, having a major stripe 143, being affixed by either a swivel, or cord or elastic means, as at 144, at either end, while a bottom portion of a stripe, as at 145, be integrated into the structure of the shown shoe. Nevertheless, the stripe 143 can be turned, or reversed, about its pivot points 144, to display a different design.

Figure 30:
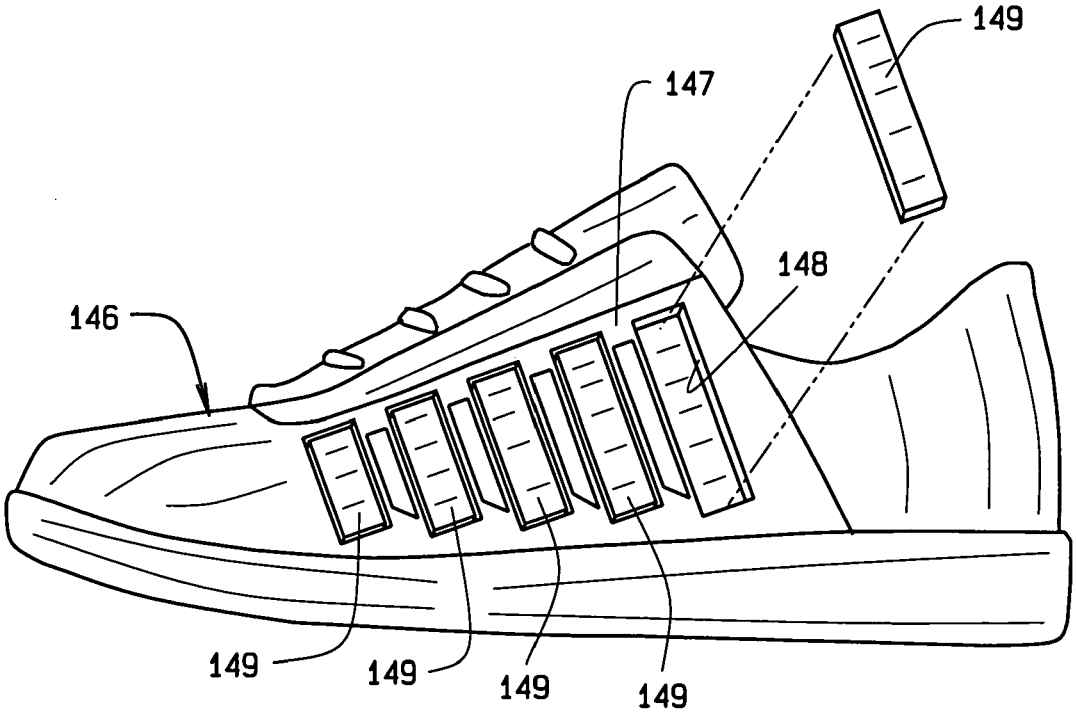
FIG. 30 shows a shoe having quarter portion recesses for receiving a changeable stripe therein.

FIG. 30 shows another method for application of stripes to footwear, as can be noted. As shown, the shoe 146, upon its upper quarter portion, as at 147, will contain a series of recessed portions as at 148, structured therein, and which may be either wedge shaped, on its edges, or perhaps utilized Velcro or other means for fastening, to hold the stripes 149 in place. This provides another method for allowing for the stripes to be located upon the surface of the footwear, but yet each stripe capable of being reversed in place, so as to display it opposite surface, in order to change the design and appearance of the shown shoe.

Figure 31:
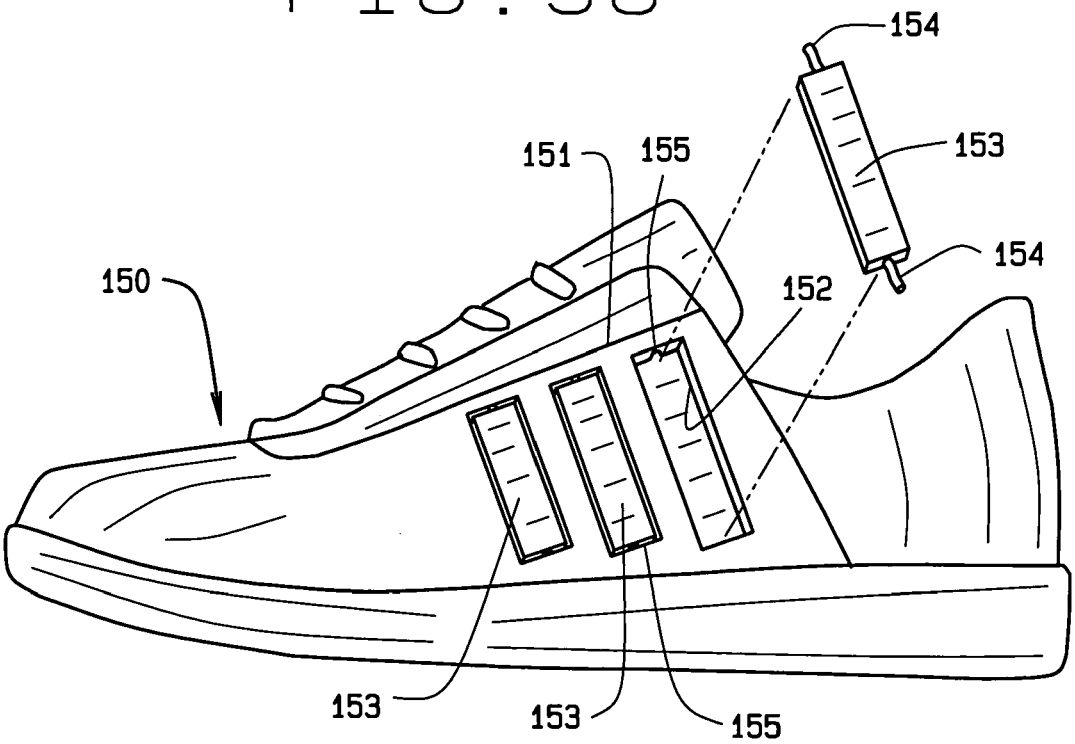
FIG. 31 shows quarter portions for a shoe having recesses for receiving pivotal changeable stripes therein.

FIG. 31 shows another modification to the subject matter of this invention. As noted, the shoe 150 once again, upon its upper quarter portion 151 includes a series of recessed areas, as at 152, to which area a stripe 153 may locate. The stripe may include either elastic cords, as at 154, or such cords may actually be fabricated as pivot pins, so as to locate within the slots 155 placed at the upper and lower ends of the slot configurations 152. This can be done for each of the stripes 153 as noted. Stripes 153 can be easily pulled free, reversed, and relocated within their recessed portions 152, to change the appearance of the shown shoe.

Figure 32:
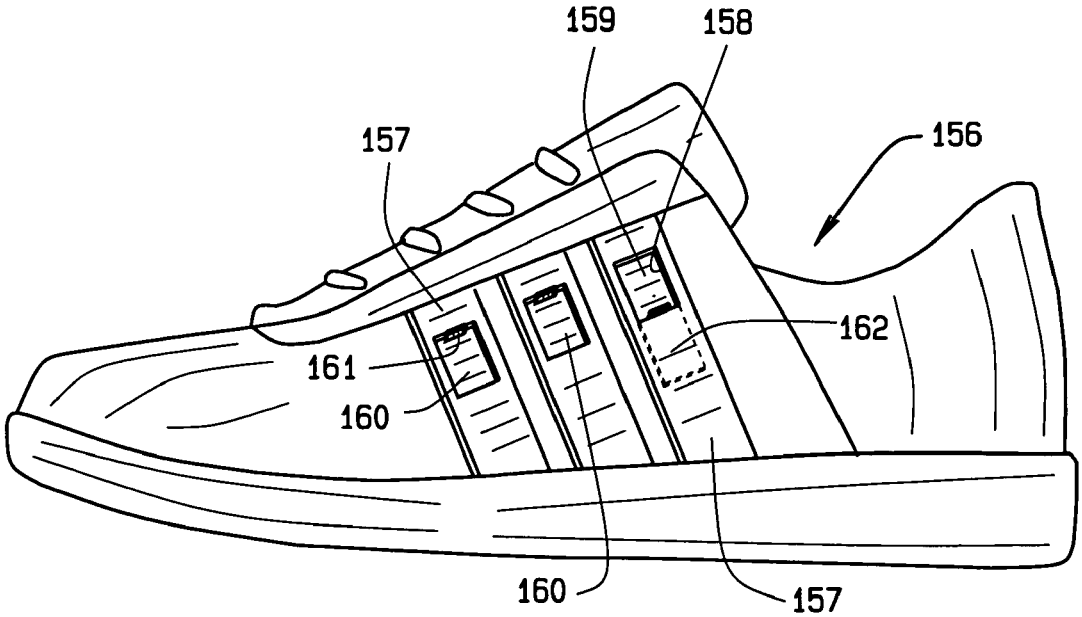
FIG. 32 shows a shoe having slideable changeable stripes applied within longitudinal pockets formed along the quarter portion of the shown shoe.

Further modification to the application of stripes upon footwear can be seen in FIG. 32. As noted, the shoe 156 has provided upon its quarter portion a series of longitudinal pockets or sleeves, as at 157, and included within each pocket is an aperture, or viewing window 158, through which the back of the pocket provides a coloration or design, as at 159. A stripe, of the slide type, as noted at 160, can be slide upwardly, by applying an upward pressure to its tab 161, to pull the stripe upwardly, from the position as shown at 162, to that as shown at 160, to display a different appearance, for the shown shoe. This is not too unlike the structure of the slide stripes as previously reviewed and explained with respect to the embodiments as shown in FIGS. 18 and 19.

Figure 33:
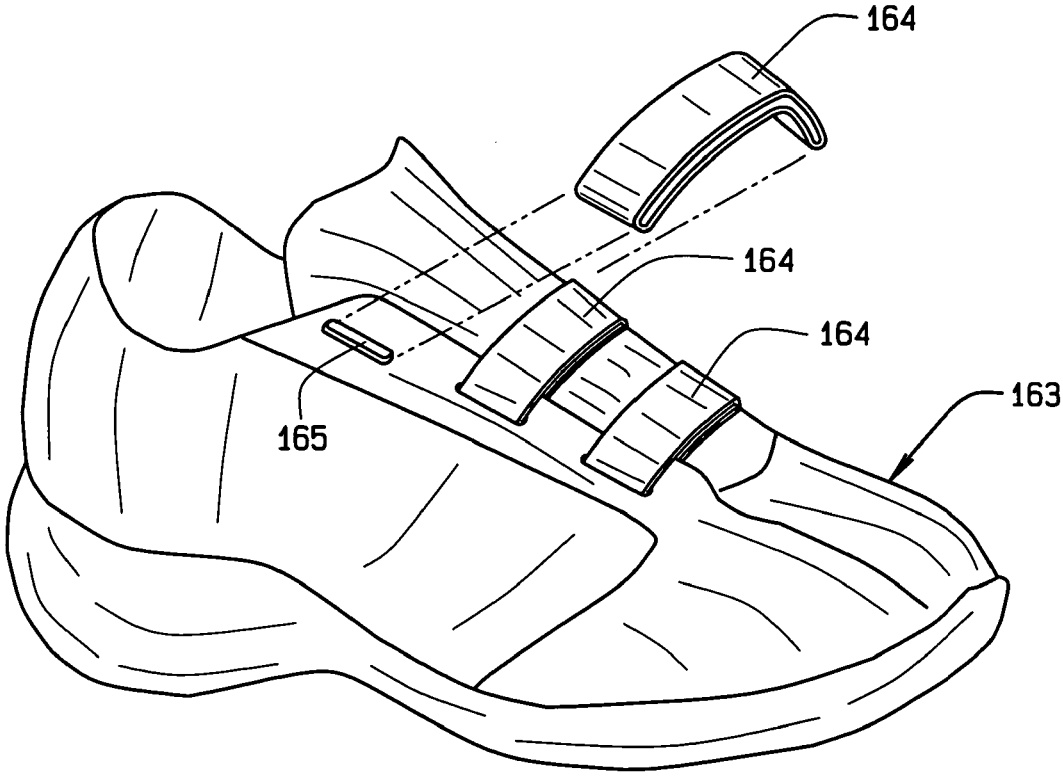
FIG. 33 shows continuous changeable stripes that insert through eyelet slots provided to either side of the tongue opening for the shown shoe.

FIG. 33 shows how a shoe, as at 163, has a series of continuous stripes 164 threaded through the slotted eyelets 165 of the shown shoe. Thus, this type of a continuous stripe will replace the lacing, for the shoe, but yet will have sufficient elasticity to allow for the foot to be entered or removed from the shoe, during usage. In addition, the stripes may have different coloration or designs thereon, so that by pulling the stripe in one direction or the other, the under surface of the continuous stripe with become exposed, upon the top of the shoe, to present a different appearance for the footwear, during usage. This shows how stripe changes can be further embodied within the structure of the shoe, to achieve the conceptual concepts desired from the usage of variable stripes within shoes structures, as shown and described herein.

Figure 34:
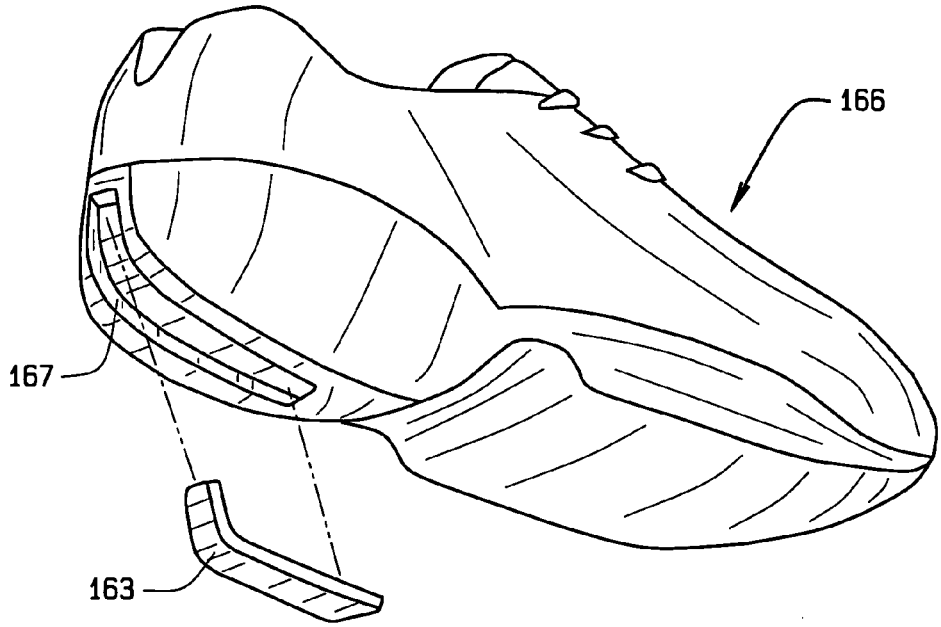
FIG. 34 shows a changeable stripe that may be applied to the counter or heel portion of the shown shoe.
Figure 35:
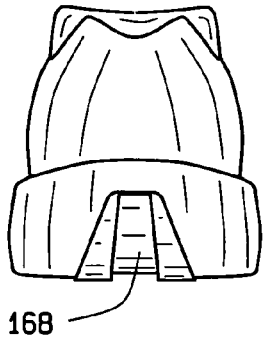
FIG. 35 provides a rear view of the shoe of FIG. 34.
Figure 36:
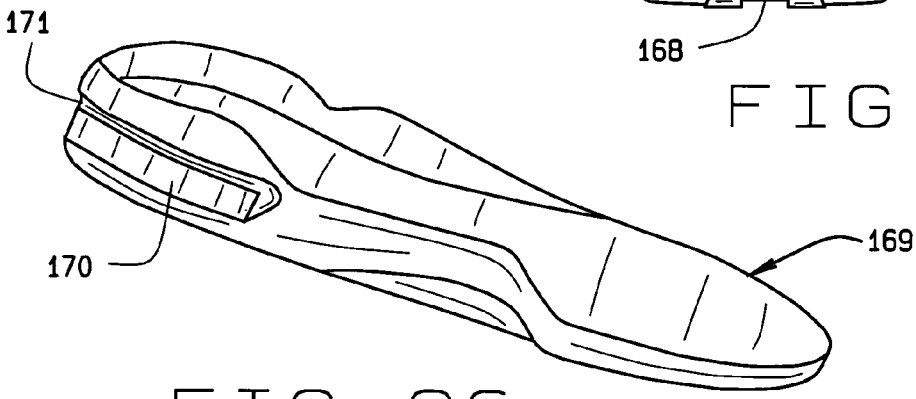
FIG. 36 shows a modification to the application of a changeable stripe around the heel portion of the shown shoe sole.

FIGS. 34 and 35 show how the shoe 166 can have a stripe located within a recess, as at 167, upon the back counter or rear heel portion of the shoe, where the stripe may extend further thereunder, during application. Thus, the stripe 168 may be located within the recess 167, or it may be removed, and reversed, and relocated therein, to furnish a different appearance to the shown shoe. Such a stripe, as can also be seen at FIG. 35, may be fabricated of a luminescent material, in order to furnish some glowing, during the evening or night, to furnish safety to the footwear when worn. In addition, the sole for a walking or running shoe as shown in FIG. 36, is seen at 169. As noted, the changeable stripe 170 can be provided recessed, as at 171, around the rear perimeter of the shown heel, but it may be reversed, so as to display different coloration, or design, or a luminescent or phosphorescent material, to add to the attractiveness and safety of any shoe to which the sole is applied.

Figure 37:
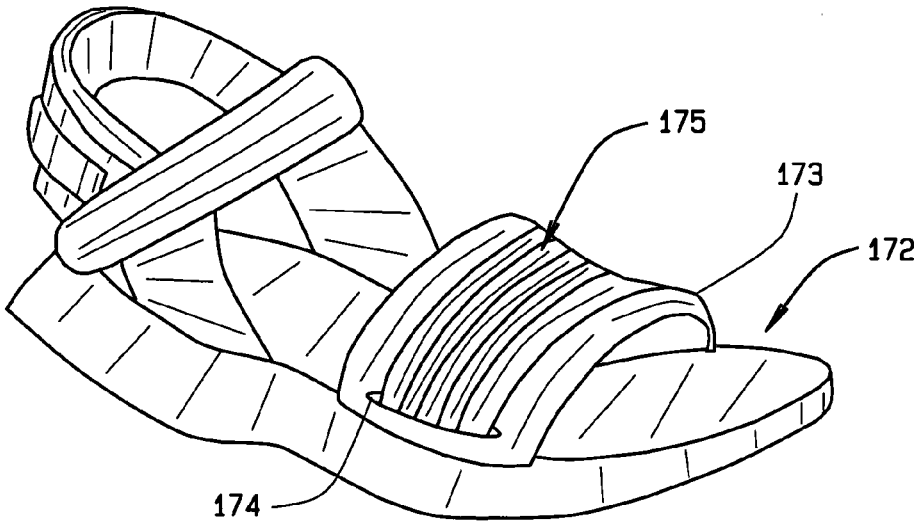
FIG. 37 provides a changeable stripe applied to the vamp strap of the shown sandal.
Figure 38:
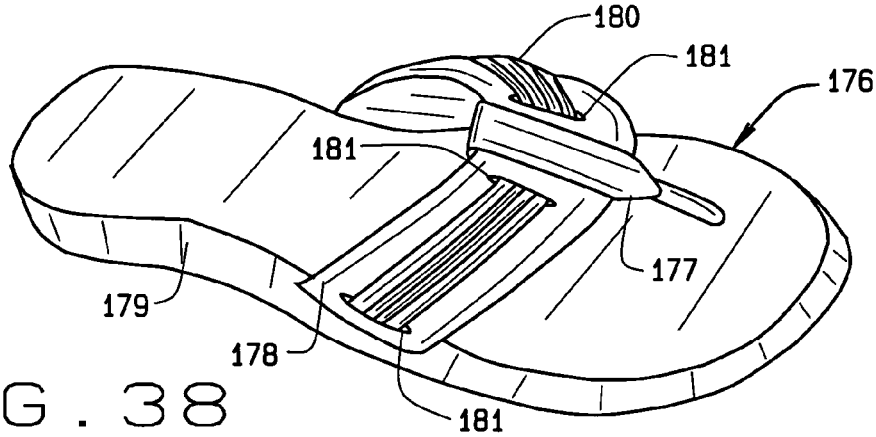
FIG. 38 shows a changeable stripe applied to a further designed vamp strap for the shown thong.

The further variation upon the use of stripes within footwear, and which can be manipulated to vary the shoe appearance, can be seen in FIGS. 37 and 38. As disclosed in FIG. 37, the shown sandal 172 has a vamp strap 173 appended to its forward sole. Within the strap 173 are a series of slots, one as shown at 174. The type of continuous material, or a series of stripes, as shown at 175, is provided over the vamp strap, through the slots, and extends contiguously adjacent the interior of the vamp 173. Hence, when the changeable stripe 175 is shifted, and pulled within the strap, and across the top, a different coloration or design may be present, to furnish a variation upon the appearance and coloration of the sandal, as can be understood. FIG. 38 shows a related type of changeable stripe concept. The sandal 176 includes the usual thong strap 177 and which embraces the lateral strap 178 affixes to the sides of the shown sole 179. The changeable stripe 180 which is continuous, extends through a series of slots, as at 181, and is formed continuous, and extends upon its underside through the strap 178, or contiguous with its inner surface. When the stripe 180 is pulled, and reversed, the opposite side of the strap will become shown, and present a different appearance for the disclosed sandal.

Figure 39:
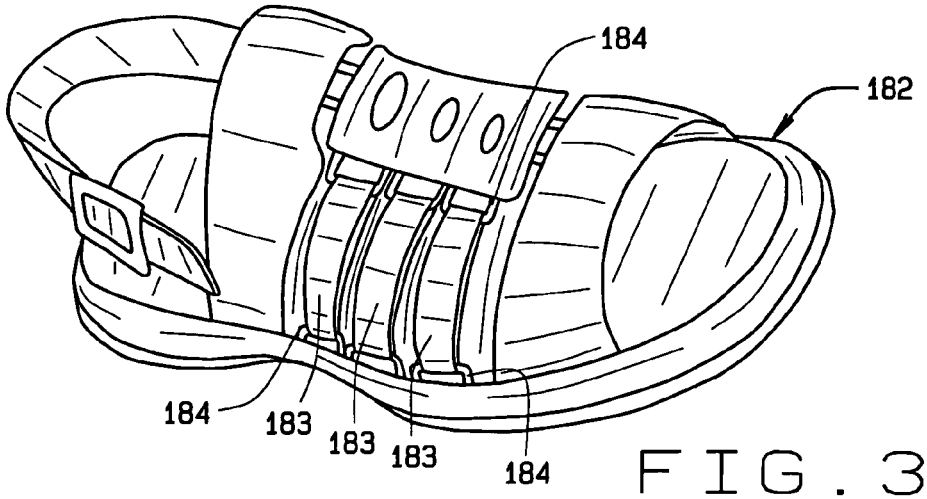
FIG. 39 shows changeable stripes applied laterally of the shown sandal and held by D or other shaped rings to both the upper buckle and lateral sole of the shown sandal.

FIG. 39 shows yet another variation upon a structure for the shown sandal 182. As noted, a series of changeable stripes 183 are held into position by a series of rings or D-rings 184, and said stripes 183 can be pulled, to reverse their exposed surfaces, to allow for variation in the appearance of the shown sandal when worn.

Figure 40:
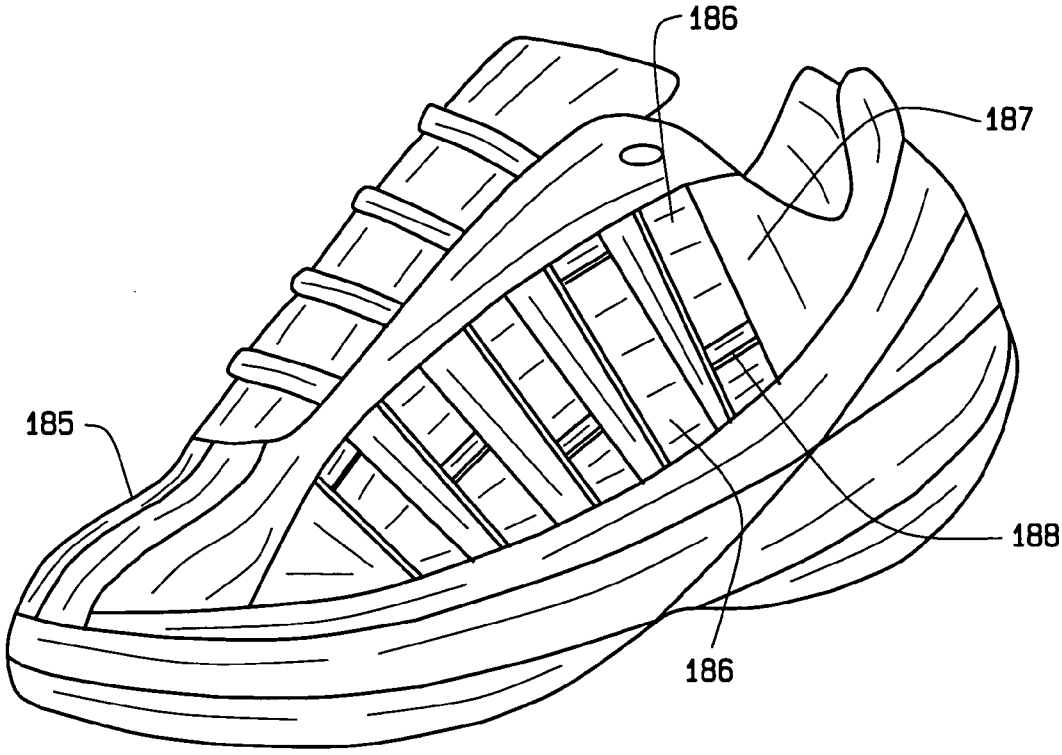
FIG. 40 shows a radiating style of changeable stripe pattern applied to the quarter portion of the shown shoe.

Another modification in the employment of changeable stripes for footwear, can be seen in FIG. 40. The shown shoe 185 has a series of changeable stripes 186, and the stripes may extend either into the quarter portion 187 of the shoe, or into its interior, such that when the continuous stripe has its tab 188 pulled, either upwardly or downwardly, a different segment of the continuous stripe will be exposed, in order to vary the coloration, design, or indicia for the shown shoe.

Figure 41:
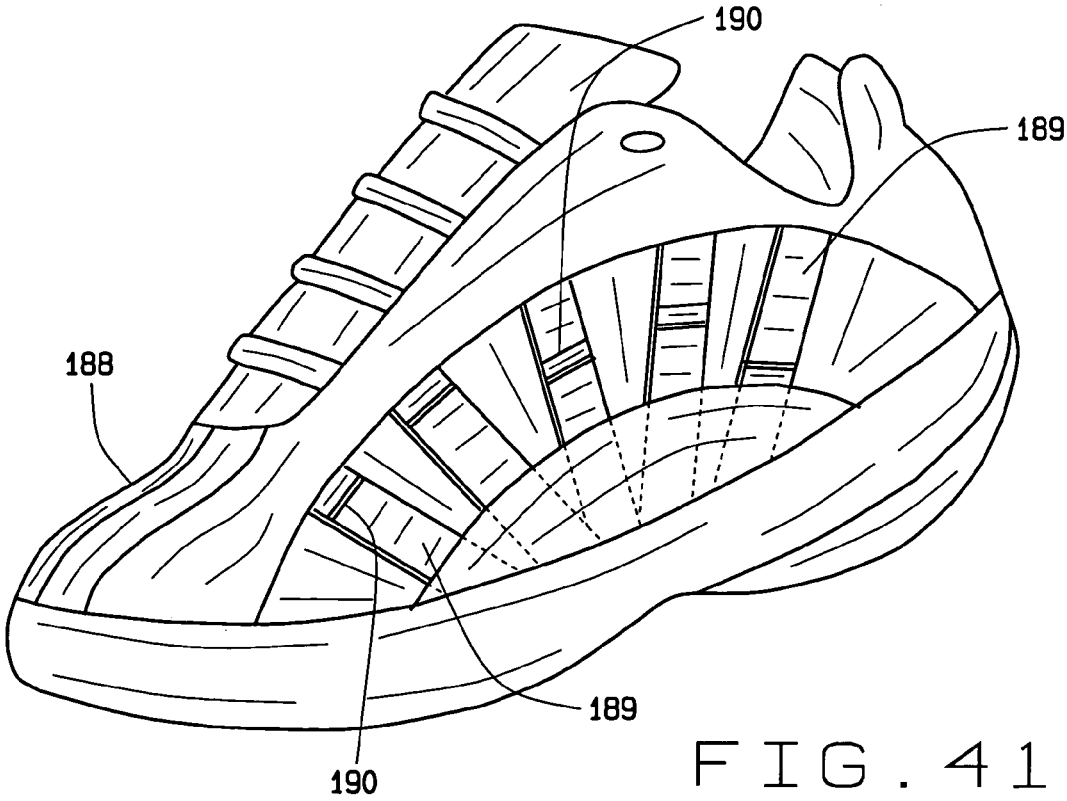
FIG. 41 shows a further radiating pattern for changeable stripes applied to the quarter portion of the shown shoe.

A similar construction as shown in FIG. 41, in the modified shoe 188 and the various stripes 189 are arranged radiating along the side for the quarter portion for the shown shoe. When the continuous stripes have their pull tabs 190 pulled one way for the other, it will expose a different segment of the shown stripe, in order to vary its appearance. Once again, the stripes are continuous, and may extend into the interior of the quarter portion, or inside of the same, such that the continuous stripe can be pulled, in one direction or the other, by exerting a force upon the pull tabs 190, to vary the appearance of the part of the stripe that is observable, to change its coloration, design, indicia, or shown trademark or trade name.

Figure 42:
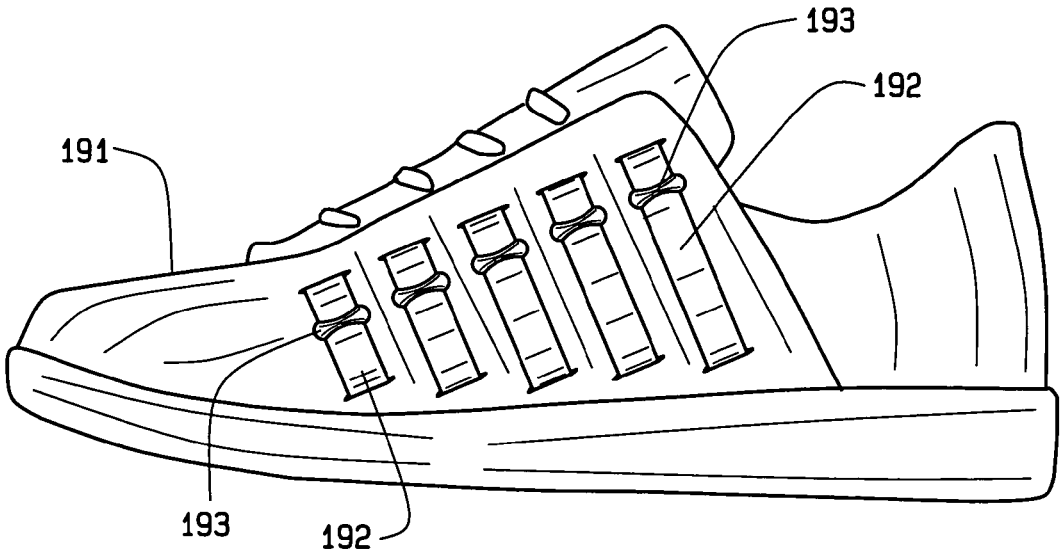
FIG. 42 shows a series of changeable stripes that may be changed, to vary the appearance of the shown shoe.
Figure 43:
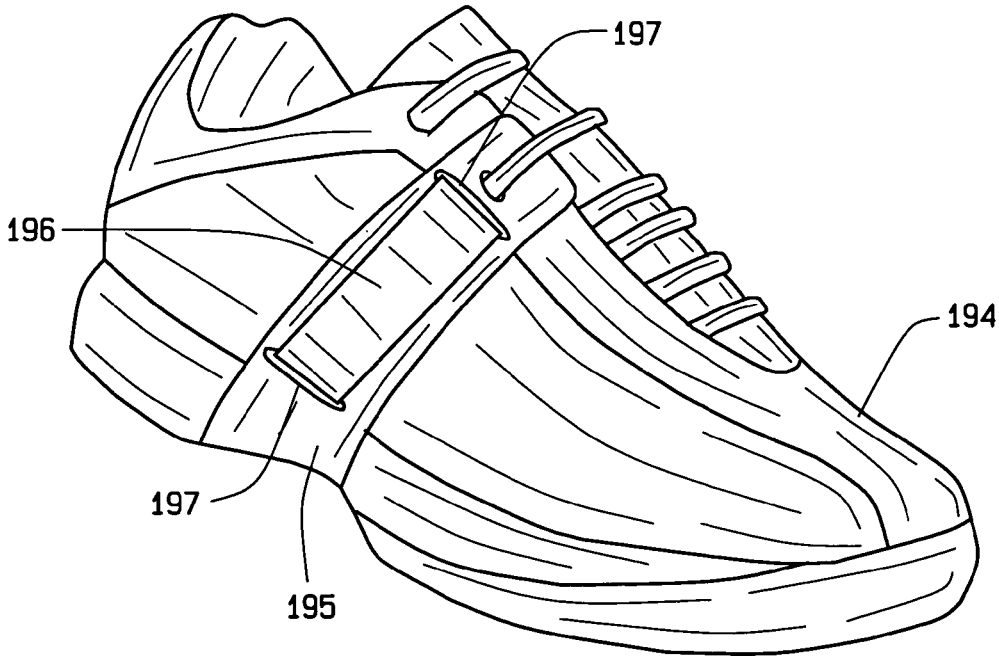
FIG. 43 shows how the continuous changeable stripe may be applied to a quarter portion strap for the disclosed shoe.

FIG. 42 shows a modified shoe 191 having the continuous stripes 192, so that as these pull tabs 193 are lifted, one way or the other, it changes that part of the stripe which is exposed, to the exterior, and vary its appearance. Likewise, the modified shoe shown in FIG. 43, as at 194, has a supplemental band, as at 195, adhered to the sole, and extending upwardly overlying the surface of the shoe quarter portion, and has a continuous strip 196 extending through the various slots 197, as shown, so the stripe can be shifted, to vary the appearance of the shoe. The inner portion of the continuous stripe 196 will rest against the interior of the disclosed band 195, as can be understood.

Figure 44:
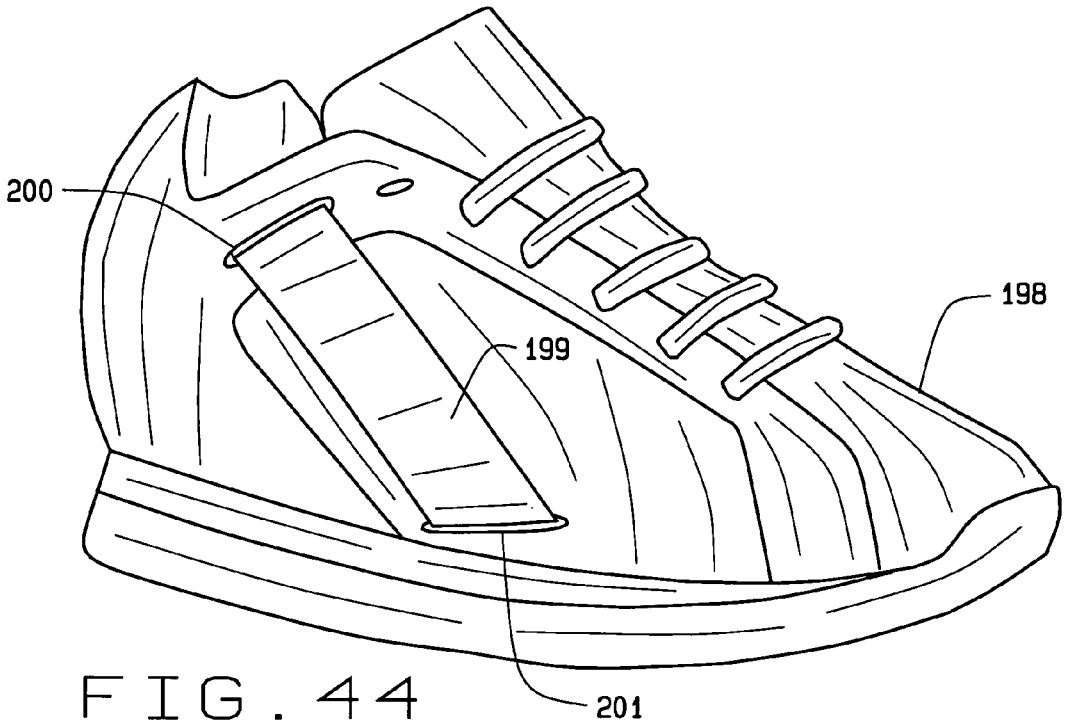
FIG. 44 shows a changeable stripe band as applied upon an incline upon the quarter portion and other portions of the shown shoe.

FIG. 44 shows a further variation upon the location of the changeable stripe of this invention, as noted. The shoe 198 will have a changeable stripe 199 provided through the slots 200 and 201, furnished through the quarter portion and other part of the shown shoe. By pulling the changeable stripe one way or the other, and since it is continuous in its structure, unexposed portions of the stripe will become apparent, and which can vary the appearance of the shoe during usage.

Figure 45:
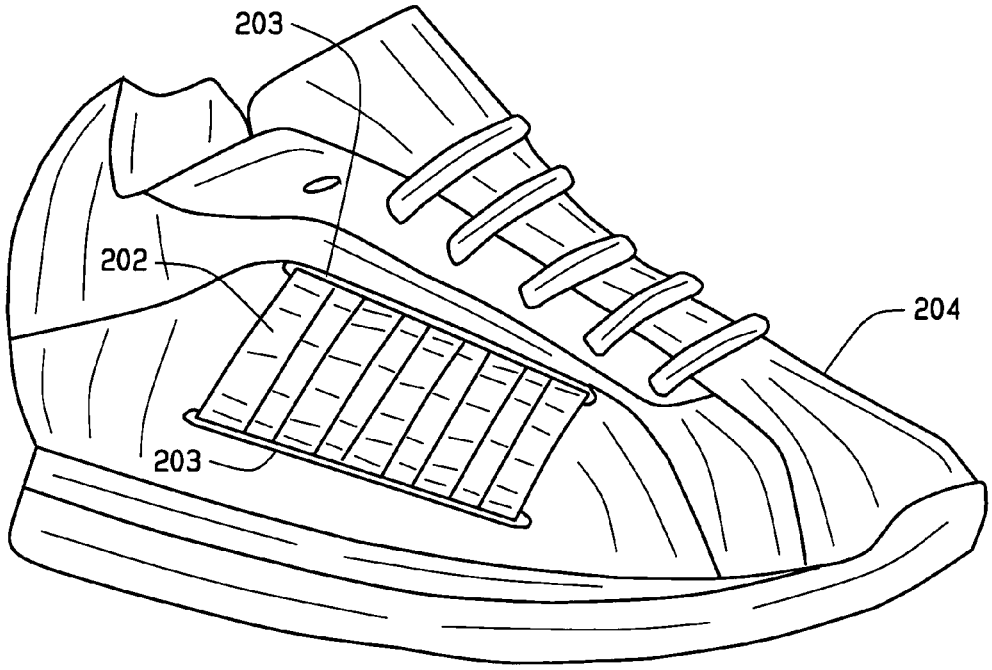
FIG. 45 shows a widened continuous stripe, in the form of a band, which may be applied for movement upon the quarter portion of the disclosed shoe.

FIG. 45 shows how a significantly wide changeable stripe or band 202 will be provided through slots 203 for the shown shoe 204. By pulling the band of the changeable stripes 202 in one direction or the other, it may expose other of its surfaces, to change the appearance of the shown shoe. This just indicates how the stripe does not necessarily need to be a singular narrow stripe, but can be of significant width, in order to add significantly to the variations in the design of the shoe, during employment and usage of the changeable stripe as shown therein. Or rods or pivotal wires can be employed as shown in FIG. 24.

Figure 46:
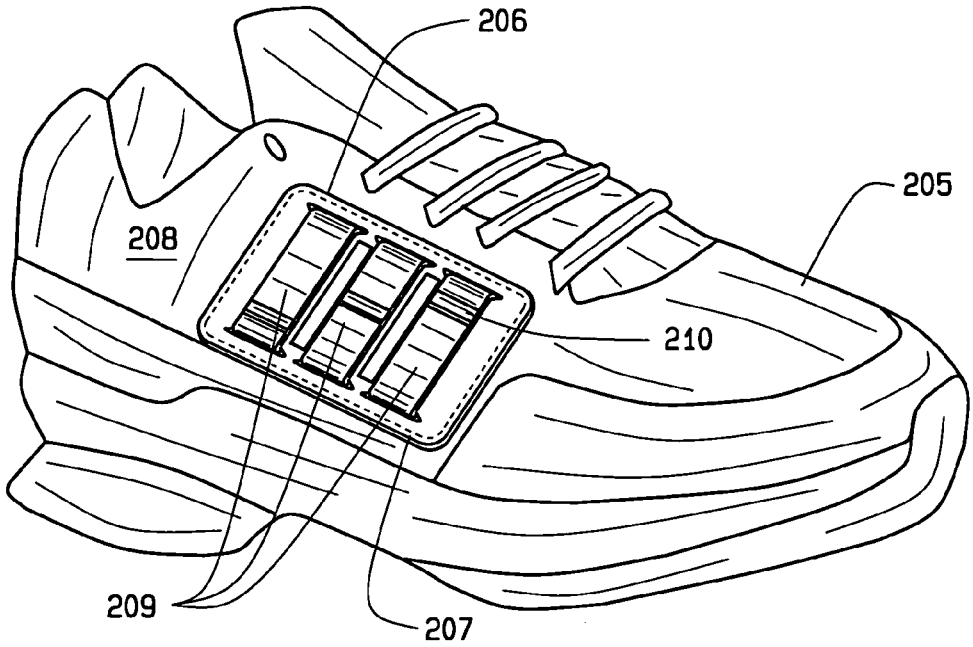
FIG. 46 shows a packet or adapter for the changeable stripes that may be stitched directly to the quarter portion of the shown shoe.
Figure 47:
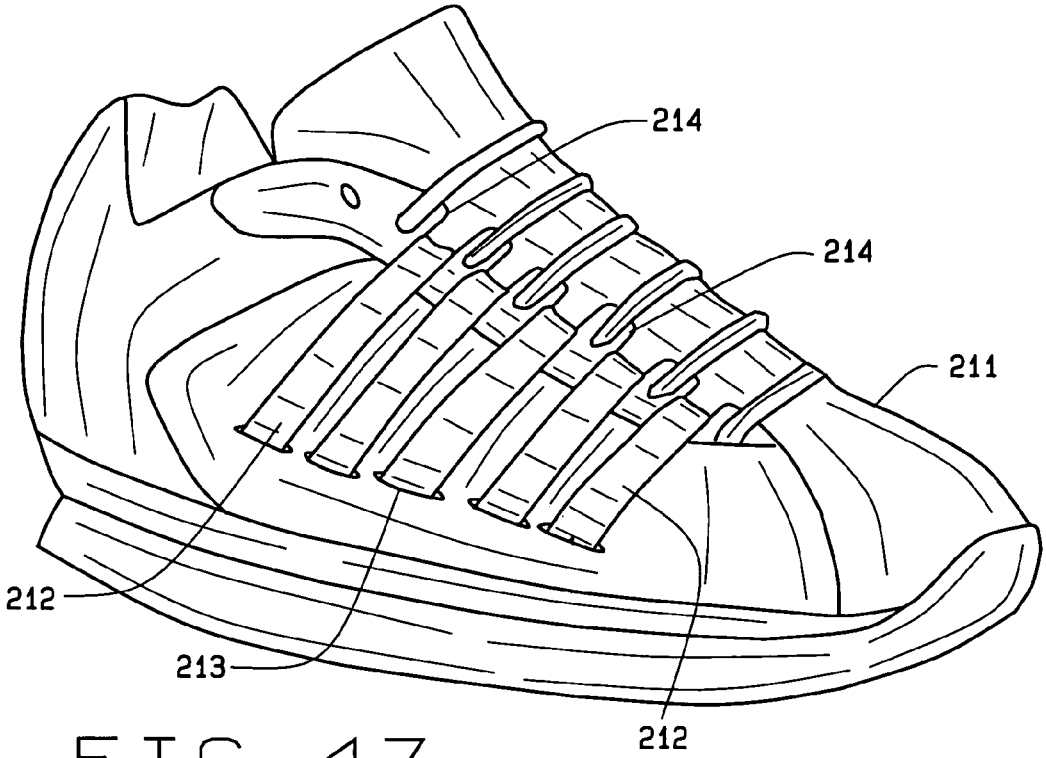
FIG. 47 shows a series of changeable stripes that may cooperate within grooves formed along the upper edges of the eye stay for the shown shoe.

FIG. 46 shows a shoe 205 and how the changeable stripes are configured into a unit, as at 206, which can then be stitched as at 207, or adhesively or otherwise secured to the upper quarter portion 208 of the shown shoe, when it is to be employed. A series of changeable stripes 209 with their pull tabs 210 can be varied, in their positioning, so as to change the coloration or appearance of the shown shoe. FIG. 47 shows a shoe 211, wherein the changeable stripes 212 insert through slots 213 the bottom of the quarter portion of the shoe, and then extend upwardly into grooves, as at 214, furnished upon the upper edges the eyestay for the shown shoe, and since said changeable stripes are continuous, the stripes can be shifted, in order to expose differencing surfaces, of the structure, to vary the appearance of the disclosed shoe. It is also likely that each of the stripes, at their bottom end, both on the inside and outside of the quarter or other portion of the footwear to which the stripes are applied, can be arranged in proximity with a slit or aperture, through which, for example, a cord, pin, elastic member, or the like, may insert, attached to both bottom ends of the stripe, so that the stripe can be turned over, in the region where it locates around the eyestay grooves, in order to reverse the stripe from one side, to the other, to change the appearance of the shoe.

Figure 48:
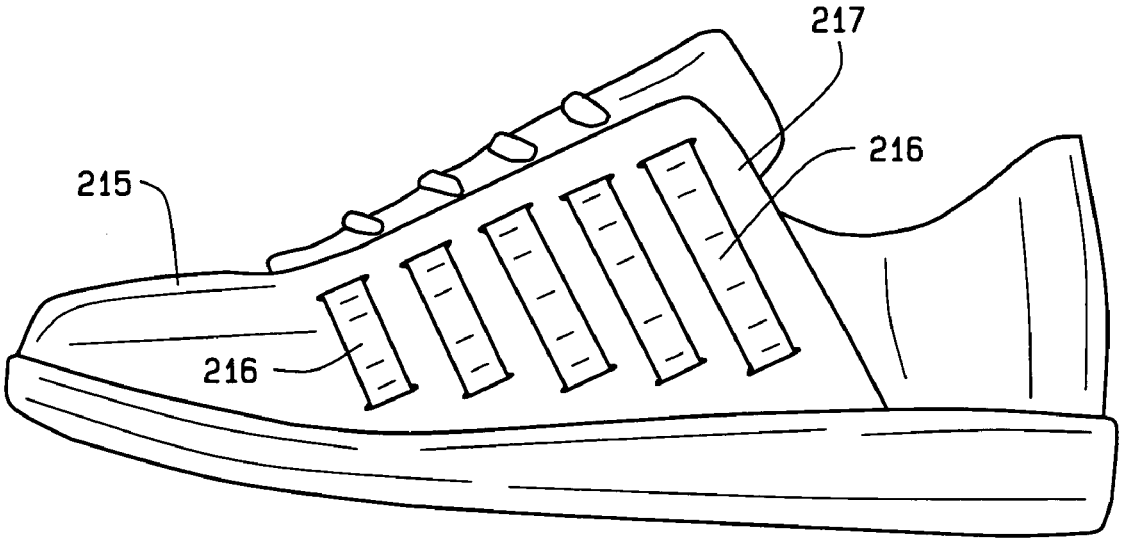
FIG. 48 shows a series of changeable stripes within a thickener or braced quarter portion for the shown shoe.

FIG. 48 shows another shoe 215 with the changeable stripes, as at 216, provided, and wherein the stripes can be varied, by shifting, to expose the undisclosed portions of the stripes, to vary the appearance of the shoes. Various stiffeners may be provided within the quarter portion 217 the shoe, in order to allow the stripes to shift more easily, so that their unexposed interior portions may be shifted exteriorly to vary the coloration, design, and the like, for the shown shoes.

Figure 49:
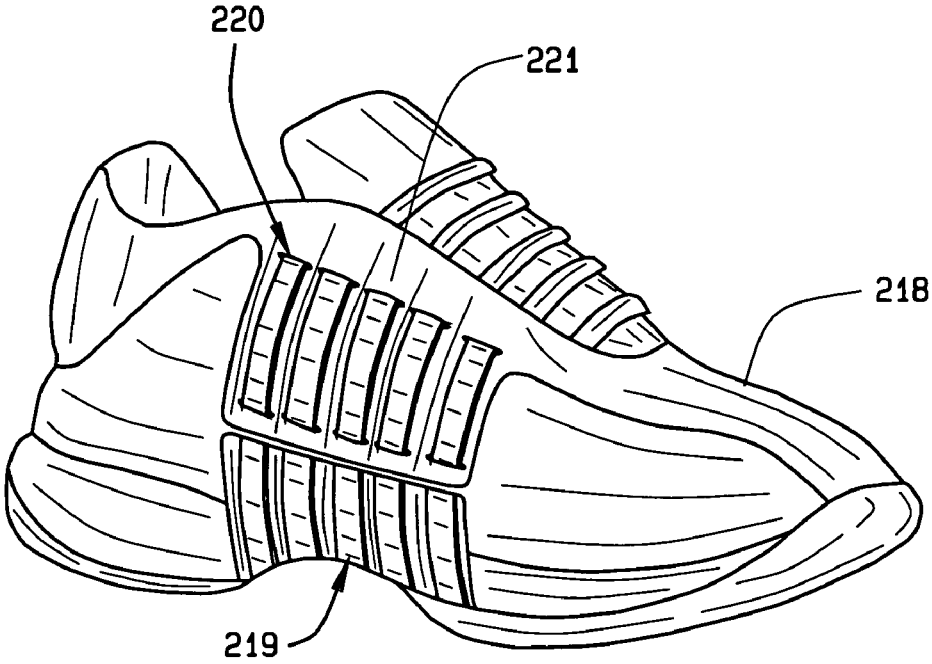
FIG. 49 shows a series of changeable stripes that may be aligned with further indicia applied longitudinally or laterally to one or both sides of the shown shoe.

FIG. 49 shows another shoe 218 wherein the shoes may have, at their lower portions, a series of more permanent stripes, as at 219, but that the changeable stripe configuration, as at 220 of the type as previously described, are arranged through slots within the quarter portion 221, so that these stripes can be varied, to change the coloration and indicia, but at the same time remain in alignment with the stripe pattern provided at the lower region of the shoe, as previously explained with respect to the location 219 of the shown shoe. This just shows how a variation upon the structure of the stripes, and how they may be coordinated in their locating upon the shown shoes, can be varied, to add to the attractiveness, design or appearance of the shown shoes, but yet incorporate the changeability feature, in a manner as previously reviewed for the various designs for footwear as shown in this disclosure.

Variations or modifications to the subject matter of this invention may occur to those skilled in the art upon review of the disclosure as provided herein. Such variations, if within the spirit of this development, are intended to be encompassed within the scope of the invention as described. The specific description of the invention, as set forth in the various embodiment, and as shown in the drawings, are provided for illustrated purposes only.

The invention claimed is:

1. Footwear incorporating at least one changeable decorative stripe, to vary the appearance of the shoe, said footwear having outer and inner surfaces, said stripe comprising a continuous band applied through the surface of the shoe, and always remaining contiguous with the outer and inner surfaces of said shoe, the shoe surface having at least a pair of slots, said continuous band being inserted therethrough, said continuous band remaining contiguous against the surfaces of the shoe between said pair of slots, whereby upon shifting of said band, a different portion of said decorative stripe is exposed for observance upon the outer surface of said shoe.

2. The footwear of claim 1 and including a tab, fastened to the band, and capable of being grasped to facilitate the shifting of the continuous band for exposing of various surfaces of the stripe upon the surface of said shoe.

3. The footwear of claim 2 wherein at least one stripe is applied to the quarter portion of said shoe.

4. The footwear of claim 2 wherein said at least one stripe is applied to the counter of the shoe.

5. The footwear of claim 2 wherein said at least one stripe is applied to the vamp of the shoe.

6. The footwear of claim 2 wherein said slots extend entirely through the surface of the shoe, and said at least one continuous band laying contiguously with the external and the internal surfaces of the said shoe surface.

7. The footwear of claim 2 wherein said slots extend partially internally through the surface of the shoe, and said at least one band extending through said slots and partially into the surface of the said shoe.

8. The footwear of claim 2 wherein there are a plurality of stripes provided upon the surface of the shoe and which can be shifted to vary the appearance of the shoe during usage.

9. The footwear of claim 8 wherein said plurality of stripes are arranged horizontally upon the surface of the shoe.

10. Footwear incorporating at least one changeable decorative stripe, to vary the appearance of the shoe, said footwear having outer and inner surfaces, said stripe comprising a continuous band applied through the surface of the shoe, and always remaining contiguous with the outer and inner surfaces of said shoes, the shoe surface having at least a pair of slots, said continuous band being inserted therethrough, said continuous band remaining contiguous against the surfaces of the shoe between said pair of slots, whereby upon shifting of said band, a different portion of said decorative stripe is exposed for observance upon the outer surface of said shoe.

11. The footwear of claim 10 wherein the stripe is formed as a band, and said band having a width, and said band when turned, provides for a variation in the decorative appearance of the shoe during usage.

12. The footwear of claim 11 wherein said stripe extends through said pair of slots provided through different segments of the shoe.

13. Footwear incorporating at least one changeable decorative stripe, to vary the appearance of the shoe, said shoe having external and internal surfaces, said stripe comprising a continuous band applied through the surface of the shoe, said shoe surface having at least a pair of slots, said continuous band inserting therethrough, a tab, said tab fasten to the band and capable of being grasped to facilitate the shifting of the continuous band for exposing various surfaces of the stripe upon the external surface of said shoe, there being a plurality of said stripes provided upon the surface of the shoe and which can be shifted to vary the appearance of the shoe during the usage, said plurality of stripes being arranged radially upon the surface of said shoe.

* * * * *